US005669035A

United States Patent [19]

Kurematsu et al.

[11] Patent Number: 5,669,035

[45] Date of Patent: Sep. 16, 1997

[54] APPARATUS FOR PROCESSING A SILVER HALIDE PHOTOSENSITIVE MATERIAL

[75] Inventors: Masayuki Kurematsu; Hiroko Ennyu; Nobuya Yamamoto, all of Hino, Japan

[73] Assignee: Konica Corporation, Tokyo, Japan

[21] Appl. No.: 697,646

[22] Filed: Aug. 27, 1996

[30] Foreign Application Priority Data

Aug. 30, 1995 [JP] Japan ..... 7-221991
Apr. 12, 1996 [JP] Japan ..... 8-091064

[51] Int. Cl.[6] ..... G03D 3/02

[52] U.S. Cl. ..... 396/626; 396/627; 396/620

[58] Field of Search ..... 396/612, 625, 396/626, 627, 630, 620; 430/398–400; 134/64 R, 64 P, 122 R, 122 P

[56] References Cited

U.S. PATENT DOCUMENTS 5,075,711 12/1991 Ohba ..... 396/617
5,414,484 5/1995 Hofmuth et al. ..... 396/626

FOREIGN PATENT DOCUMENTS 0 418 757 A2 3/1991 European Pat. Off. .
23 61 150 6/1975 Germany .
5-11422 1/1993 Japan ..... 396/942
62-87964 2/1993 Japan ..... 396/943
1 504 402 3/1978 United Kingdom .

*Primary Examiner*—D. Rutledge
*Attorney, Agent, or Firm*—Frishauf, Holtz, Goodman, Langer & Chick, P.C.

[57] ABSTRACT

A photosensitive material processing apparatus comprises a first processor having a first retaining member in which a solution is stored, a second processor positioned beneath the first processor and having a second retaining member into which the solution is shifted from the first processor, and a conveyor for conveying a photosensitive material upward from the second processor to the first processor so that the photosensitive material is firstly processed by the second processor and thereafter processed by the first processor.

15 Claims, 13 Drawing Sheets

APPARATUS FOR PROCESSING A SILVER HALIDE PHOTOSENSITIVE MATERIAL

BACKGROUND OF THE INVENTION

The present invention relates to a technology which downsizes an automatic processing machine for silver halide photographic light-sensitive material wherein rapid photographic processing with high quality is conducted with a small amount of processing solution.

Heretofore, if an automatic processing machine which develops silver halide photographic light-sensitive material (hereinafter, it may be referred to as simply "light-sensitive material") is that for black-and-white light-sensitive material as shown in a schematic drawing shown in FIG. 17, a developing tank, a fixing tank and a washing tank are arranged from the upstream side. Following the washing tank, the final section is a drying section. Black-and-white film F, which is a light-sensitive material, passes the conveyance path for the light-sensitive material formed by several paired rollers which are immersed in each processing solution in each processing tank. Finally, the light-sensitive material is dried in the drying section and the developed black-and-white film is taken up.

When the light-sensitive material is a color paper, its processing steps becomes different, wherein the developing tank is a color developing (CD) tank, the fixing tank is a bleach-fixing (BF) tank, the washing tank is a stabilizing tank and there are plural stabilizing tanks. Overall, the number of tanks is increased. In addition, when the light-sensitive material is a color film, the number of processing steps is further increased, and the number of processing tanks is also further increased.

On the other hand, in the above-mentioned automatic processing machines, a multi-step counter flow system is known and is put into practical use wherein, as shown in schematic side view in FIG. 18, a processing tank in one processing step is divided into two or more processing tanks, they are arranged in a series and processing solutions and washing water flows counter to the arrowed direction of the conveyance direction of the color paper as a light-sensitive material.

This is constituted in such a manner that processing solution is replenished into the final of plural processing tanks in one processing step and the processing solution flows in a direction reverse to the advancement of the light-sensitive material in aforesaid plural processing tanks so that the processing solution overflows from the most upstream tank to be discharged bit by bit.

In washing and stabilizing tanks, the replenishing amount of washing water and the processing solution can be reduced by utilizing the above-mentioned multi-step counter flow type of processing. In addition, in the fixing tank and the bleach-fixing tank, due to utilizing the above-mentioned multi-step counter flow type, the degree of contamination of the processing solution (in other words, the density of the dissolved material from the light-sensitive material becomes lower) as the process goes downstream. Therefore, desilvering speed of the light-sensitive material becomes higher. Accordingly, enhancement of processing time becomes possible in addition to reduced need of the replenishing amount of the processing solution.

Though effects of reduction of replenishing amount and enhancement of processing become greater as the number of processing tanks is increased in the above-mentioned multi-step counter flow type, the overall dimensions of the apparatus become larger due to increasing the number of tanks and locating them in series. The reason for this is that at least a prescribed curvature is necessary for the reversing section in the conveyance path of the light-sensitive material to prevent scratches so that there is a practical limit in terms of downsizing the tanks. Due to the shortcoming of apparatus dimensions increase, the number of tanks actually put into practical use are 2 for the fixing tank in color negative film processing, 3 for the stabilizing tank and 3–4 for the stabilizing tank and the washing tank in color paper processing. As a result, effects of reduction of replenishing amount and enhancement of processing in the multi-step counter flow type are restricted.

In addition, when the replenishing amount of washing water and the processing solution is reduced, the renewal ratio of washing water and the processing solution is lowered so that the washing water and the processing solution are retained for a relatively long time. Accordingly, problems of deterioration of the washing water and the processing solution and the generation of micro-bacteria occur. Accordingly, it is generally necessary to use various storage stabilizers for the stabilizing solution and the fixing solution.

In addition, there is another system for reducing the solution amount in the processing tanks as shown in FIG. 19, a partial side cross sectional view, by providing a processing tank having a shape in accordance with the conveyance path of light-sensitive material F. However, in this method, there is no change in terms of processing speed compared to conventional solution dipping. In addition, the replenishing amount of the processing solution is not be reduced. Furthermore, there is a great difficulty in manufacturing the processing tanks having a shape in accordance with the conveyance path of light-sensitive material F from viewpoint of the degree of tightly closeness of the container against solution leakage.

SUMMARY OF THE INVENTION

The present invention was made against the above-mentioned problems. The major objects are to provide an automatic processing machine for silver halide photographic light-sensitive material wherein rapid processing, downsizing of an apparatus, reduction of the replenishing amount of the processing solution, reduction of discharged effluent of washing solution or stabilizing solution (or zero flowing), and reduction of cost are achieved and a method of of processing the same.

The present invention was attained by the following discoveries. Namely, the present inventors paid close attention to paired rollers which sandwich the light-sensitive material for conveyance. By providing a processing solution retention means such as a solution reservoir to the above-mentioned paired rollers, one set of paired rollers are considered to be a processing tank. By placing plural paired rollers vertically, plural processing tanks can be constituted. The present invention is based on an idea that, if the light-sensitive material is conveyed upward by means of the above-mentioned plural paired rollers and the processing solution is flowed downward, a multi-step counter flow system can be constituted by means of plural paired rollers.

Table 1 shows change of density of the processing solution components carried over in each tank from the preceding processing step when the replenishing amount of processing solution to the final tank was varied, provided that the processing solution amount carried over from the preceding processing step to a multi-step counter flow system processing tank together with the light-sensitive material is 50 ml/m$^2$.

TABLE 1

| Replenishing amount ($ml/m^2$) | 1st tank | 2nd tank | 3rd tank | 5th tank | 8th tank | 12th tank |
|---|---|---|---|---|---|---|
| 100 | 1/2 | 1/4 | 1/8 | 1/32 | 1/256 | 1/6144 |
| 300 | 1/6 | 1/36 | 1/216 | 1/7776 | $1/1.7 \times 10^6$ | $1/2.2 \times 10^9$ |
| 500 | 1/10 | 1/100 | 1/1000 | $1/10^5$ | $1/10^8$ | $1/10^{12}$ |
| 1000 | 1/20 | 1/400 | 1/8000 | $1/3.2 \times 10^6$ | $1/2.6 \times 10^{10}$ | $1/4.1 \times 10^{15}$ |
| 10000 | 1/200 | 1/40000 | $1/8 \times 10^6$ | $1/3.2 \times 10^{11}$ | $1/2.6 \times 10^{18}$ | $1/4.1 \times 10^{27}$ |

As described above, by adopting the multi-step counter flow system, the density of the processing solution component in the final tank can noticeably be reduced.

In the conventional system in which tanks were placed in series, 2–4 tanks were the upper limit because the dimensions of the processing machine became too large. However, in the present invention, a multi-step counter flow system is constituted by arranging plural paired rollers vertically in one tank. Accordingly, the dimension of the processing machine does not become large. By arranging 8–12 paired rollers, effects of 8–12 tank multi-step counter flow system as shown in Table 1 can be obtained. Therefore, in a small-sized low-cost processing machine, the replenishing amount of processing solution can noticeably be reduced.

In addition, since the processing solution retention amount means the retention amount by the processing solution retention means provided in paired roller, aforesaid amount is small and renewal rate by the processing solution replenished from above is speedy so that remaining period of the processing solution is extremely short. Accordingly, a problem of the processing solution storage stability which is the shortcoming of the multi-step counter flow system can be overcome by the present invention.

In addition, when the 8–12 paired rollers arrangement of the present invention is applied to the fixing step or the bleach-fixing step, silver density at the final pair can noticeably be reduced so that processing speed can be increased.

The above-mentioned objective is attained by either of the following technological means (1) through (66).

(1) An automatic processing machine for silver halide photographic light-sensitive material which processes an exposed silver halide photographic light-sensitive material with a processing solution, wherein aforesaid silver halide photographic light-sensitive material is brought into contact with the processing solution retained on the upper rollers after aforesaid silver halide photographic light-sensitive material is brought into contact with the processing solution retained on the lower rollers due to a structure in which aforesaid silver halide photographic light-sensitive material is conveyed from bottom to top, plural rollers having a processing solution retaining function is brought into contact with aforesaid silver halide photographic light-sensitive material vertically, a means for feeding the processing solution to the upper roller and/or aforesaid silver halide photographic light-sensitive material and a means for adjusting the temperature of aforesaid processing solution fed are provided and the processing solution fed onto the upper roller and/or aforesaid silver halide photographic light-sensitive material is fed onto the lower rollers from the upper rollers due to gravity.

(2) The automatic processing machine for silver halide photographic light-sensitive material described in item (1) above, wherein the surface of the above-mentioned rollers having the processing solution retaining function is porous so that the processing solution is absorbed and retained.

(3) The automatic processing machine for silver halide photographic light-sensitive material described in item (1) above, wherein the above-mentioned rollers having the processing solution retaining function has a structure in which a solution reservoir container is provided below the rollers and lower rollers are absorbed in a solution which was reserved in aforesaid container.

(4) An automatic processing machine for silver halide photographic light-sensitive material which processes an exposed silver halide photographic light-sensitive material with a processing solution, wherein aforesaid silver halide photographic light-sensitive material is brought into contact with the processing solution adhered on the rollers or contained in the processing solution retention member due to a structure in which aforesaid silver halide photographic light-sensitive material is conveyed from lower to upper, plural rollers is brought into contact with aforesaid silver halide photographic light-sensitive material vertically, a processing solution retention means is provided in at least one of between, above and below the rollers, a means for feeding the processing solution to the upper roller and/or the processing solution retention member and/or aforesaid silver halide photographic light-sensitive material and a means for adjusting the temperature of aforesaid processing solution fed are provided and the processing solution fed onto the upper roller and/or aforesaid silver halide photographic light-sensitive material is fed onto the lower rollers from the upper rollers due to gravity.

(5) The automatic processing machine for silver halide photographic light-sensitive material described in any one of items (1) through (4) above, wherein the above-mentioned fed amount of processing solution is in a range of 1–50 times the amount of processing solution carried over to the following step due to being adhered on or absorbed in the silver halide photographic light-sensitive material.

(6) The automatic processing machine for silver halide photographic light-sensitive material described in any one of items (1) through (5) above, wherein the above-mentioned plural rollers having the processing solution retentive function are plural paired rollers sandwiching the silver halide photographic light-sensitive material and having the processing solution retentive function.

(7) The automatic processing machine for silver halide photographic light-sensitive material described in any one of items (1) through (6) above, wherein the fed processing solution is a new processing solution which is new and has not been used for processing.

(8) The automatic processing machine for silver halide photographic light-sensitive material described in any one of items (1) through (7) above, wherein a processing section including the above-mentioned rollers is included in a container for making a processing tank and means for heating at least one of the rollers, the processing solution retained by the rollers and the processing solution retention member.

(9) The automatic processing machine for silver halide photographic light-sensitive material described in any one of items (1) through (8) above, wherein a prescribed amount of aforesaid processing solution is fed in addition to a stipulated amount against the processing amount of the silver halide photographic light-sensitive material either when starting operation, when processing after the silver halide photographic light-sensitive material has not been processed for a long time or when the operation is finished.

(10) An automatic processing machine for silver halide photographic light-sensitive material which processes an exposed silver halide photographic light-sensitive material in a fixing step and a step, having a washing step or a stabilizing step, which follows aforesaid fixing step, wherein the silver halide photographic light-sensitive material is conveyed from a down path to an up-path in a form of U-turn, a fixing solution reservoir section having a temperature adjusting means which heats the fixing solution is provided at the lower portion of the down-path, a means for circulating the fixing solution and bringing into contact with the silver halide photographic light-sensitive material during downward conveyance from the fixing solution reservoir section, a means for feeding water or a stabilizing solution to the silver halide photographic light-sensitive material from the upper portion of the up-path and a means for adjusting temperature which heats aforesaid fed water or stabilizing solution, a means or a structure which flows a part of or all water or a stabilizing solution dropped from the up-path into the above-mentioned fixing solution reservoir section and a means for supplying a condensed fixing agent to the fixing section.

(11) The automatic processing machine for silver halide photographic light-sensitive material described in item (10) above, wherein a means for feeding water or the stabilizing solution to the silver halide photographic light-sensitive material from the upper portion of an up-path in item (10) above has a structure in which the above-mentioned water or stabilizing solution is fed to the lower rollers from the upper rollers among the rollers vertically positioned and having the processing solution retentive function due to gravity.

(12) The automatic processing machine for silver halide photographic light-sensitive material described in item (11) above, wherein the above-mentioned rollers having the processing solution retentive function is absorbed in the water or the stabilizing solution due to using a porous material on the roller surface.

(13) The automatic processing machine for silver halide photographic light-sensitive material described in items (11) above, wherein the above-mentioned rollers having the processing solution retentive function is provided with a solution reservoir contained below the rollers and the lower rollers are absorbed in a solution reserved in aforesaid container.

(14) The automatic processing machine for silver halide photographic light-sensitive material described in items (10) above, wherein a means for feeding water or a stabilizing solution onto the silver halide photographic light-sensitive material from above the up-path described in item (10) above has a structure that the above-mentioned water or stabilizing solution is fed to the lower rollers from the upper rollers among rollers placed vertically due to gravity.

(15) The automatic processing machine for silver halide photographic light-sensitive material described in any one of items (10) through (14) above, wherein the above-mentioned fed amount of water or stabilizing solution is in a range of 1–50 times the amount carried over to the following step due to being adhered on or absorbed in the silver halide photographic light-sensitive material.

(16) The automatic processing machine for silver halide photographic light-sensitive material described in any one of items (11) through (15) above, wherein the above-mentioned rollers having the processing solution retentive function are paired rollers sandwiching the silver halide photographic light-sensitive material and having the processing solution retentive function.

(17) The automatic processing machine for silver halide photographic light-sensitive material described in any one of items (11) through (16) above, wherein the water or stabilizing solution is a new water or stabilizing solution which is new and has not been used for processing.

(18) The automatic processing machine for silver halide photographic light-sensitive material described in any one of items (11) through (17) above, wherein a processing section including the above-mentioned rollers is included in a container for making a processing tank and a means for heating at least one of the rollers, the processing solution retained by the rollers and the processing solution retention member is provided.

(19) The automatic processing machine for silver halide photographic light-sensitive material described in any one of items (11) through (18) above, wherein a prescribed amount of water or stabilizing solution is fed in addition to a stipulated amount against the processing amount of the silver halide photographic light-sensitive material either when starting operation, when processing after the silver halide photographic light-sensitive material has not been processed for a long time or when the operation is finished.

(20) The automatic processing machine for silver halide photographic light-sensitive material described in any one of items (10) through (19) above, wherein the above-mentioned portion in which a light-sensitive material is enclosed from downward direction to upward direction in a U-turn form is covered by a container or a processing tank so that they have a substantially tightly-closed structure in which inside air is difficult to be exchanged by outside air.

(21) An automatic processing machine for silver halide photographic light-sensitive material which processes an exposed silver halide photographic light-sensitive material in a bleaching step and a step, having a fixing step, which follows aforesaid bleaching step, wherein the silver halide photographic light-sensitive material is conveyed from a down path to an up-path in a form of U-turn, a bleaching solution reservoir section having a temperature adjusting means which heats the bleaching solution is provided at the lower portion of the down-path, a means for circulating the bleaching solution and bringing into contact with the silver halide photographic light-sensitive material, which is being during downward conveyance, from the bleaching solution reservoir section is provided, a means for feeding fixing solution to the silver halide photographic light-sensitive material from the upper portion of the up-path and a means for adjusting temperature which heats aforesaid fed fixing solution, the above-mentioned portion in which the light-sensitive material path goes from downward to upward is covered as one container and a means for adjusting temperature by heating inside aforesaid container is provided.

(22) The automatic processing machine for silver halide photographic light-sensitive material described in item (21) above, wherein a means for feeding fixing solution onto the silver halide photographic light-sensitive material from above the up-path described in item (21) above has a structure in which the above-mentioned fixing solution is fed to the lower rollers from the upper rollers among rollers placed vertically due to gravity.

(23) The automatic processing machine for silver halide photographic light-sensitive material described in item (22) above, wherein the above-mentioned rollers having the processing solution retentive function is absorbed in the fixing solution due to using a porous material on the roller surface.

(24) The automatic processing machine for silver halide photographic light-sensitive material described in item (22)

above, wherein the above-mentioned rollers having the processing solution retentive function is provided with a solution reservoir contained below the rollers and the lower rollers are absorbed in a solution reserved in aforesaid container.

(25) The automatic processing machine for silver halide photographic light-sensitive material described in item (21) above, wherein a means for feeding fixing solution onto the silver halide photographic light-sensitive material from above the up-path described in item (21) above has a structure that the above-mentioned fixing solution is fed to the lower rollers from the upper rollers among rollers placed vertically due to gravity.

(26) The automatic processing machine for silver halide photographic light-sensitive material described in any one of items (21) through (25) above, wherein the above-mentioned fed amount of fixing solution is in a range of 1–50 times the amount carried over to the following step due to being adhered onto or absorbed in the silver halide photographic light-sensitive material.

(27) The automatic processing machine for silver halide photographic light-sensitive material described in any one of items (22) through (26) above, wherein the above-mentioned rollers having the processing solution retentive function are paired rollers sandwiching the silver halide photographic light-sensitive material and having the processing solution retentive function.

(28) The automatic processing machine for silver halide photographic light-sensitive material described in any one of items (21) through (27) above, wherein the fixing solution is a new water or stabilizing solution which is new and has not been used for processing.

(29) The automatic processing machine for silver halide photographic light-sensitive material described in any one of items (22) through (28) above, wherein a processing section including the above-mentioned rollers is included in a container for making a processing tank and a means for heating at least one of the rollers, the processing solution retained by the rollers and the processing solution retention member is provided.

(30) The automatic processing machine for silver halide photographic light-sensitive material described in any one of items (21) through (29) above, wherein a prescribed amount of fixing solution is fed in addition to a stipulated amount compared to the processing amount of the silver halide photographic light-sensitive material either when starting operation, when processing after the silver halide photographic light-sensitive material has not been processed for a long time or when the operation is finished.

(31) The automatic processing machine for silver halide photographic light-sensitive material described in any one of items (21) through (30) above, wherein the above-mentioned portion in which a light-sensitive material is conveyed from downward direction to upward direction in a U-turn form is covered by a container or a processing tank so that they have a substantially tightly-closed structure in which inside air is difficult to be exchanged by outside air.

(32) An automatic processing machine for silver halide photographic light-sensitive material which processes an exposed silver halide photographic light-sensitive material in a bleaching step and a step, having a fixing step, which follows aforesaid bleaching step, wherein the silver halide photographic light-sensitive material is conveyed from a down path to an up-path in a form of U-turn and then to a down-path, a bleaching solution reservoir section having a temperature adjusting means which heats the bleaching solution is provided at the lower portion of the first down-path, a means for circulating the bleaching solution and bringing into contact with the silver halide photographic light-sensitive material, which is being during downward conveyance, from the bleaching solution reservoir section is provided, a fixing solution reservoir section having a temperature adjusting means which heats the fixing solution is provided below the first up-path and the second down-path separately, a means for circulating and contacting fixing solution to the silver halide photographic light-sensitive material during conveyance is provided, a means for feeding the fixing solution is provided in the fixing section in the second down-path and the above-mentioned fixing section in the first up-path is structured that the fixing solution overflow from the fixing section in the second down-path enters the fixing section in the first up-path.

(33) The automatic processing machine for silver halide photographic light-sensitive material described in item (32) above, wherein the above-mentioned portion in which a light-sensitive material is conveyed at least from downward direction to upward direction and then downward direction in U-turn forms is covered by a container or a processing tank so that they have a substantially tightly-closed structure in which inside air is difficult to be exchanged by outside air.

(34) The automatic processing machine for silver halide photographic light-sensitive material described in either of items (32) or (33) above, wherein an up-path is provided following the above-mentioned second down-path and washing or stabilizing is conducted in aforesaid up-path.

(35) The automatic processing machine for silver halide photographic light-sensitive material described in item (34), wherein a means for feeding water or a stabilizing solution onto the silver halide photographic light-sensitive material from above the above-mentioned up-path following the second down-path has a structure that the above-mentioned water or stabilizing solution is fed onto the lower rollers from the upper rollers each positioned at an upper portion and a lower portion and each having the processing solution retentive function.

(36) The automatic processing machine for silver halide photographic light-sensitive material described in item (35) above, wherein the above-mentioned rollers having the processing solution retentive function is absorbed in the water or the stabilizing solution due to using a porous material on the roller surface.

(37) The automatic processing machine for silver halide photographic light-sensitive material described in item (35) above, wherein the above-mentioned rollers having the processing solution retentive function is provided with a solution reservoir contained below the rollers and the lower rollers are absorbed in a solution reserved in aforesaid container.

(38) The automatic processing machine for silver halide photographic light-sensitive material described in item (34) above, wherein a means for feeding water or stabilizing solution onto the silver halide photographic light-sensitive material from above the up-path described in item (34) above has a structure that the above-mentioned fixing solution is fed to the lower rollers from the upper rollers among rollers placed vertically due to gravity.

(39) The automatic processing machine for silver halide photographic light-sensitive material described in any one of items (34) through (38) above, wherein the above-mentioned fed amount of water or stabilizing solution is in a range of 1–50 times the amount carried over to the following step due to being adhered on or absorbed in the silver halide photographic light-sensitive material.

(40) The automatic processing machine for silver halide photographic light-sensitive material described in any one of items (35) through (39) above, wherein the above-mentioned rollers having the processing solution retentive function are paired rollers sandwiching the silver halide photographic light-sensitive material and having the processing solution retentive function.

(41) The automatic processing machine for silver halide photographic light-sensitive material described in any one of items (34) through (40) above, wherein the water or stabilizing solution is a new water or stabilizing solution which is new and has not been used for processing.

(42) The automatic processing machine for silver halide photographic light-sensitive material described in any one of items (35) through (41) above, wherein a processing section including the above-mentioned rollers is included in a container for making a processing tank and a means for heating at least one of the rollers, the processing solution retained by the rollers and the processing solution retention member is provided.

(43) The automatic processing machine for silver halide photographic light-sensitive material described in any one of items (34) through (42) above, wherein a prescribed amount of water or stabilizing solution is fed in addition to a stipulated amount compared to the processing amount of the silver halide photographic light-sensitive material either when starting operation, when processing after the silver halide photographic light-sensitive material has not been processed for a long time or when the operation is finished.

(44) An automatic processing machine for silver halide photographic light-sensitive material which dries an exposed silver halide photographic light-sensitive material in a drying step after the developing step and two or more following steps therefrom, wherein U-turns made by a down-path and an up-path for the silver halide photographic light-sensitive material are continuously provided in processing tanks, at least two processing steps following the developing step are not completely partitioned to form one processing tank though the developing step is completely partitioned from other processing steps and two or more processing steps in which the processing tanks are not completely partitioned feed the processing solution to the silver halide photographic light-sensitive material conveyed outside the solution.

(45) The automatic processing machine for silver halide photographic light-sensitive material described in item (44) above, wherein a structure to feed the above-mentioned processing solution for photographic processing as described in item (44) has a structure that a means for feeding the processing machine to the silver halide photographic light-sensitive material from above the up-path feeds the above-mentioned processing solution from the upper rollers to the lower rollers among rollers positioned vertically and having the processing solution retentive function due to gravity.

(46) The automatic processing machine for silver halide photographic light-sensitive material described in item (45) above, wherein the above-mentioned rollers having the processing solution retentive function is absorbed in the water or the stabilizing solution due to using a porous material on the roller surface.

(47) The automatic processing machine for silver halide photographic light-sensitive material described in item (45) above, wherein the above-mentioned rollers having the processing solution retentive function is provided with a solution reservoir contained below the rollers and the lower rollers are absorbed in a solution reserved in aforesaid container.

(48) The automatic processing machine for silver halide photographic light-sensitive material described in item (44) above, wherein a means for feeding a processing solution onto the silver halide photographic light-sensitive material from above the up-path described in item (44) above has a structure that the above-mentioned processing solution is fed to the lower rollers from the upper rollers among rollers placed vertically due to gravity.

(49) The automatic processing machine for silver halide photographic light-sensitive material described in one of items (44) through (48) above, wherein the above-mentioned fed amount of processing solution is in a range of 1–50 times the amount carried over to the following step due to being adhered on or absorbed in the silver halide photographic light-sensitive material.

(50) The automatic processing machine for silver halide photographic light-sensitive material described in any one of items (45) through (49) above, wherein the above-mentioned rollers having the processing solution retentive function are paired rollers sandwiching the silver halide photographic light-sensitive material and having the processing solution retentive function.

(51) The automatic processing machine for silver halide photographic light-sensitive material described in any one of items (44) through (50) above, wherein the processing solution is a new processing solution which is new and has not been used for processing.

(52) The automatic processing machine for silver halide photographic light-sensitive material described in any one of items (45) through (51) above, wherein a processing section including the above-mentioned rollers is included in a container for making a processing tank and a means for heating at least one of the rollers, the processing solution retained by the rollers and the processing solution retention member is provided.

(53) The automatic processing machine for silver halide photographic light-sensitive material described in any one of items (44) through (52) above, wherein a prescribed amount of processing solution is fed in addition to a stipulated amount against the processing amount of the silver halide photographic light-sensitive material either when starting operation, when processing after the silver halide photographic light-sensitive material has not been processed for a long time or when the operation is finished.

(54) The automatic processing machine for silver halide photographic light-sensitive material described in any one of items (44) through (55) above, wherein the above-mentioned developing steps has a structure in which inside the processing tanks are filled with a developing solution and the silver halide photographic light-sensitive material is conveyed in the developing solution.

(55) The automatic processing machine for silver halide photographic light-sensitive material described in any one of items (1) through (54) above, wherein aforesaid machine has a means for sensing the processing amount of silver halide photographic light-sensitive material which enters the above-mentioned automatic processing machine for silver halide photographic light-sensitive material and the supplying amount of the above-mentioned processing solution onto the upper rollers is controlled in accordance with the processing amount of the above-mentioned silver halide photographic light-sensitive material.

(56) An automatic photographic processing method for silver halide photographic light-sensitive material described in any one of either items (10 through (56) which processes silver halide photographic light-sensitive material wherein the regulated and set temperature of the processing solution in a processing step which feeds the processing solution onto the silver halide photographic light-sensitive material conveyed outside the solution is set in a range from 40°–70° C.

(57) The automatic photographic processing method for silver halide photographic light-sensitive material described in item (56) above, wherein the above-mentioned processing step is a fixing step and/or a washing step or stabilizing step following aforesaid fixing step and half or more of the cation in the thiosulfate and sulfite used in the fixing solution is sodium ion.

(58) An automatic processing machine for photographic light-sensitive material which processes an exposed surface-shaped photographic light-sensitive material by bringing it into contact with the processing solution, wherein there is a portion where aforesaid photographic light-sensitive material is conveyed vertically, plural rollers placed horizontally against the above-mentioned portion are provided in such a manner that they are brought into contact with or they are close to the photographic light-sensitive material running vertically, a solution reservoir in which a part of rollers are immersed is provided below aforesaid rollers, the processing solution in aforesaid solution reservoir is fed to the photographic light-sensitive material due to the rotation of the rollers, a means for feeding the processing solution to the upper rollers and/or the solution reservoir and overflow from the upper rollers and/or the solution reservoir is dripped and fed to the lower rollers and/or the solution reservoir.

(59) The automatic processing machine for photographic light-sensitive material described in item (1), wherein the upper and the lower solution reservoirs respectively have an overflow section and the processing solution overflowing from the upper solution reservoir is discharged after flowing in a shaft direction of the rollers in the solution reservoir after dripping into the lower solution reservoir.

(60) The automatic processing machine for photographic light-sensitive material described in item (59), wherein aforesaid solution reservoir has an overflow discharging section on the end side of the rollers, the solution is dripped and fed to the end side and the solution is overflowed and discharged after flowing from one end to the opposite end.

(61) The automatic processing machine for photographic light-sensitive material described in any one item of (58)–(60), wherein each rollers is placed in a form of roller pair which sandwiches the photographic light-sensitive material from a front surface and the rear surface and solution flow due to dripping from the solution reservoir below both rollers of roller pair which sandwiches the photographic light-sensitive material to the lower solution reservoir crosses between solution reservoirs on the front surface and the rear surface of photographic light-sensitive material.

(62) The automatic processing machine for photographic light-sensitive material described in any one item of (58)–(61), wherein rollers sandwiching the photographic light-sensitive material is positioned in a zigzag form and they sandwiches the photographic light-sensitive material from the front surface and the rear surface.

(63) The automatic processing machine for photographic light-sensitive material described in any one item of (58)–(61), wherein each rollers is placed in a form of roller pair which sandwiches the photographic light-sensitive material from a front surface, a solution reservoir below roller pair which sandwiches the photographic light-sensitive material is manufactured integrally and aforesaid solution reservoir has a running-rectangular horizontal projection form in which a slit window through which the photographic light-sensitive material passes is formed at center.

(64) The automatic processing machine for photographic light-sensitive material described in item of (63), wherein the dimensions of the horizontal projection form of the above-mentioned solution reservoir is larger than that of the horizontal projection form of roller pairs and the horizontal projection form of the former includes that of the latter.

(65) The automatic processing machine for photographic light-sensitive material described in any one item of (58)–(64), wherein there is a storage tank for the fed processing solution, a heating and temperature-adjusting means is provided on a path which feeds the processing solution from the storage tank to the rollers and/or the solution reservoir, concurrently with this, a heating and temperature-adjusting means is also to the solution reservoir to which the processing solution is fed provided and the entire processing section composed of plural rollers and the solution reservoir is covered to form a substantially a tightly closed structure and air in the processing solution is heated and adjusted.

(66) The automatic processing machine for photographic light-sensitive material described in any one item of (58)–(65), wherein the rollers having the solution reservoir are driving rollers and, during that the operation stops, it is controlled that the rollers is driven for a prescribed time at an interval of a prescribed time.

The structure described in item (1) in which plural rollers are placed vertically while bringing into contact with the silver halide photographic light-sensitive material.

Roller pairs which sandwich the light-sensitive material are placed vertically or rollers are placed vertically in which each roller and a guide member in which at least one surface is plane-like sandwich a film.

The processing solution always adheres on or is contained in the surface of the rollers having the processing solution retentive function as described in item (1) above, wherein the surface of the rollers are manufactured with a water-absorption material or a function to constantly feed a prescribed amount of the processing solution on the surface of the roller is provided.

A silver halide photographic light-sensitive material, referred to as a light-sensitive material, includes color paper, color film, black-and-white film, graphic art film and X-ray film.

In addition, a processing solution includes a developing solution, a color developing solution, a fixing solution, a bleaching solution, a bleach-fixing solution, a washless-stabilizing solution, a stabilizing solution, a rinsing solution, water, small-amount water and preliminary-washing water.

The processing solution retention member described in item (4) is a member made of a water-absorption material in which the processing solution is absorbed.

"Conveyed outside the solution" described in item (44) refers to convey the light-sensitive material in the air by means of a conveyance rollers.

Effects of the present invention will be explained referring to Examples.

Effects Regarding to Item (1)

Due to rollers having a light-sensitive material processing solution retentive function, the light-sensitive material is conveyed in the air from lower to upper and the processing solution is fed onto the rollers and/or the light-sensitive material from upper. Accordingly, after the light-sensitive material is brought into contact with the processing solution retained by the lower rollers, it is brought into contact with the processing solution retained in the upper roller. Therefore, the light-sensitive material is processed by the processing solution having less degree of contamination (the density of diluted materials from the light-sensitive material is lower) successively as conveyed to the rollers. In other words, this is a system in which the processing solution is counter-flowed against the conveyance direction of the light-sensitive material. Since this system has the identical functions as conventional multi-step counter flow system wherein plural processing tanks are positioned in series, processing can be conducted effectively with a small amount of processing solution. Therefore, rapid processing can be conducted.

In addition, due to providing a temperature adjusting mechanism and thereby the light-sensitive material is processed with the processing solution with high temperature (≧40° C.) processing time can extremely be reduced and conveyance path can be shortened. In addition, it is not necessary to arrange plural processing tanks in series as in conventional multi-step counter flow systems. Accordingly, the machine can noticeably be downsized.

Namely, the above-mentioned effects lead to reduction of replenishing amount, making rapid processing and downsizing of the machine. In addition, the number of rollers placed vertically corresponds to the number of processing tanks position in series in the case of multi-step counter flow processing.

In addition, the processing solution feeding system in the present invention feeds an amount corresponding to the processing amount of light-sensitive material. Since the amount of storage is the amount retained in the rollers only, processing can be conducted while the amount of solution in the storage section is little compared with the conventional solution dipping processing system. Therefore, the renewal ratio of the processing solution is so high that the processing solution is quickly renewed in such a manner that air oxidation does not cause a problem even if rapid processing at high temperature is conducted. No oxidized precipitants occurs on the rollers.

As the rollers having the processing solution retentive function, materials having chemical durability such as a woven fabric, non woven fabric, sintered body and a sponge are preferable. From viewpoint of preventing scratches on the light-sensitive material, soft materials are preferable. In addition, it is preferable that the surface of rollers is a material having water-absorption property or is covered with a water absorption material.

The material of the woven fabric or non woven fabric is preferably polyolefin-containing fibers, polyester-containing fibers, polyacrylonitrile-containing fibers, aliphatic polyamide-containing fibers, aromatic polyamide-containing fibers and polyphenylene sulfide fibers.

The material of porous materials (sponge type) is preferably silicone rubber, polyurethane rubbers, ethylene propylene rubbers (EPDM), polyvinyl alcohol (PVA), neoprene rubbers and butyl-rubber-containing fibers.

Effects Regarding to Item (2)

The preferable material of the rollers having the processing solution retentive function in item (1) is practically porous. The kinds thereof are as follows. Due to this, the rollers can sufficiently absorb and retain the fed processing solution. Accordingly, the multi-step counter flow function effectively functions.

Effects Regarding to Item (3)

The preferable embodiment of the rollers having the processing solution retentive function described in item (1) is structured that a solution reservoir is provided below the rollers, a part of the processing solution fed from the above the rollers is reserved in aforesaid reservoir and a part of the rollers is immersed in a solution in the reservoir. Accordingly, even if the rollers is not a water-absorbing material, a multi-step counter flow function can be provided. Due to the rotation of the rollers, the processing solution is adhered on the surface of the rollers to be retained. Therefore, the light-sensitive material during conveyance is brought into contact with the processing solution adhered on the surface of the rollers to be processed.

Incidentally, the solution reservoir has preferably a structure in which the solution is adhered uniformly on the overall surface of the rollers when the rollers are rotated.

In addition, it is also preferable to combine the rollers whose surface is a water-absorption material and the solution reservoir.

Effects Regarding to Item (4)

Item (4) provides the processing solution retention member in place of providing the rollers with the processing solution retentive function. Due to placing the processing solution retention member in at least one of between, below and above the rollers and due to processing in the same manner as in item (1), the light-sensitive material is brought into contact with the processing solution absorbed in the processing solution retention member to be retained and be processed. Therefore, the multi-step counter flow function can be provided. Concurrently with this, processability is so improved that processing time can be reduced.

The material for the processing solution retention member may be anything provided that it is a water-absorption material which absorbes the processing solution to keep. For example, woven fabrics, non woven fabrics and porous materials are cited. The functions of the processing solution retention member made of such materials is a guide member for the light-sensitive material, a means for causing the processing solution absorbed and retained by aforesaid member directly to be brought into contact with the light-sensitive material or a means for feeding the processing solution indirectly to the light-sensitive material by causing the processing solution retention member to be brought into contact with the rollers and thereby adhering the processing solution onto the surface of the rollers and causing the rollers to be brought into contact with the light-sensitive material.

Effects Regarding to Item (5)

By controlling the amount of feeding the processing solution to 1 to 50 times the amount of the processing solution carried over by the light-sensitive material due to a structure described in items (1) through (4), more appropriate processing can be conducted.

When the feeding amount is ≦1 time, a multi-step counter flow function cannot work between each rollers.

When the feeding amount is >50 times, processability is not improved by increasing to 50 or more times. In addition, it is not preferable since the amount of effluent is increased.

Effects Regarding to Item (6)

By arranging the rollers described in items (1) through (5) to be plural rollers which sandwich the light-sensitive material and having the processing solution retentive function, a processing solution squeezing effect on the light-sensitive material by the rollers can be obtained and the difference of the degree of contamination on the processing solution retention section is increased. Accordingly, the density difference in the multi-step counter flowing can be increased. As a result, more preferable effects can be resulted in.

Effects Regarding to Item (7)

In items (1) through (6), if a processing solution fed is a new processing solution, the output portion of the light-sensitive material becomes closer to the new solution so that processing speed is improved and the processing solution replenishing amount is further reduced. As a result, more preferable effects can be obtained.

Effects Regarding to Item (8)

Due to heating at least one of the rollers, the processing solution retained by the rollers and the processing solution retention member, the processing solution whose temperature is regulated is brought into contact with the light-sensitive material under stable solution temperature wherein the processing solution whose temperature is regulated is not chilled due to contacting the rollers or the above-mentioned member. Accordingly, rapid and stable processing becomes possible. As a result, rapid processing at high temperature, making compact and downsizing and reduction of cost can be effected.

Effects Regarding to Item (9)

Due to feeding a prescribed amount of fixing solution in addition to a stipulated amount against the processing amount of the silver halide photographic light-sensitive material either when starting operation, when processing after the silver halide photographic light-sensitive material has not been processed for a long time or when the operation is finished, stable processing can constantly be conducted since the start of processing while the above-mentioned rollers or the above-mentioned member is not dried. In addition, coagulation of solid substances from residual solution on the above-mentioned rollers and the above-mentioned members due to evaporation of moisture is prevented. Evaporation correction function is obtained due to the above-mentioned structure.

Effects Regarding to Item (10)

Due to a structure in which the light-sensitive material is conveyed from a down-path to an up-path in a form of U-turn and the down-path is a fixing step and the up-path is the washing step or the stabilizing step, rapid processing and downsizing can be effected due to a small amount such as a diluting water for a fixing condensed solution in the up-path step and also due to the multi-step counter flow function. In addition, in the fixing step in the down-path, a fixing solution reservoir section is provided below the rollers so that the heated fixing solution is circulated and brought into contact with the light-sensitive material during the down-path conveyance to be processed. In this occasion, by processing the light-sensitive material while regulating the temperature, stable processing can be conducted.

By collecting two steps, i.e., the fixing step and the washing step, in one processing tank, a cross-over section rollers between two tanks can be removed. Accordingly, making compact, downsizing and cost reduction can be realized.

Due to a structure in which a fixing solution condensed agent is replenished to the fixing solution reservoir as necessary and that a part of or all of washing water (or a stabilizing solution) dropped from the up-path is flowed into the fixing solution reservoir, washing water effluent can be re-utilized as a dissolution water for the fixing replenishing solution and thereby washing water effluent can noticeably reduced or substantially cause to zero flow. A system in which the feeding of washing water or stabilizing solution is controlled to an amount in accordance with the light-sensitive material processing amount and that they are reserved in separate tanks so that feeding can be conducted by a quantity measuring pump together with the supply of the fixing solution condensed agent is preferable.

Effects Regarding to Items (11) through (19)

Due to arranging the constitution of item (1) to the constitution of items (11) through (19), washing and stabilizing efficiency in the up-path is increased so that reduction of replenishing solution can be effected.

Effects Regarding to Item (20)

Due to applying an upper lid on the above-mentioned conveyance section for shielding and making it substantially tightly-closed structure, evaporation of moisture from the processing solution is prevented and leaking out of odor to the outside is also prevented. Therefore, maintaining of solution temperature is effected and rapid processing at high temperature can be conducted.

Effects Regarding to Item (21)

The automatic processing machine described in item (21) is applied for an automatic processing machine for color film, wherein a down-path is a bleaching step and an up-path is a fixing step. Compared with conventional processing tank system, making compact and downsizing of the automatic processing machine is effected.

Effects Regarding to Items (22) through (30)

The automatic processing machines described in items (22) through (30) are the same as those described in items (11) through (19), wherein washing water or the stabilizing solution is replaced by the fixing solution limitedly.

Effects Regarding to Item (31)

The same as described in item (20).

Effects Regarding to Item (32)

Due to this, making compact and downsizing of the automatic processing machine for light-sensitive material becomes possible compared with conventional solution tank type.

Effects Regarding to Item (33)

The same as described in item (20).

Effects Regarding to Item (34)

Following the constitution described in item (32), a washing step or a stabilizing step is provided in the up-path, which further leads to downsizing.

Effects Regarding to Items (35) through (43)

The automatic processing machines described in items (35) through (43) are the same as those described in items (11) through (19).

Effects Regarding to Item (44)

The constitution described in item (44) is that a light-sensitive material is continuously conveyed from the down-path to the up-path in a form of U-turn in the developing step and two or more following steps. Since the light-sensitive material is conveyed outside the solution in one processing tank for at least two or more steps other than the developing step.

Effects Regarding to Items (45) through (53)

In addition to the effects described in item (44), effects identical to those described in items (2) through (9) are obtained.

Effects Regarding to Item (54)

In the developing step described in item (44), constantly stable processability is secured more strictly when a solution-dipping processing type wherein the developing solution is filled with the processing tank is adopted.

Even if the developing solution is slightly mixed in steps thereafter, no specific problem occurs. Accordingly, even if the processing solution is sprayed onto the light-sensitive material while it is conveyed in the air, no specific problem occurs.

Effects Regarding to Item (56)

By setting the range of the processing solution temperature to 40°–70° C., rapid processing can be conducted. Conventionally, however, deterioration of the processing solution at such high temperature causes problems so that rapid processing was actually impossible. However, in accordance with items (1) through (54), almost only necessary amount is fed. Therefore, rapid processing at high temperature became possible. When the processing solution temperature is less than 40° C., no noticeable improvement is observed comparing with ordinary processing in terms of fixing (or bleaching) processing. In terms of the washing or stabilizing processing, microbiological slime easily occurs. However, in the case of 40° C. or higher, contamination due to microbiology is difficult to occur.

When the temperature is 70° C. or higher, physical scratches on the rollers easily occurs. In addition, even if the temperature is raised to 70° C. or higher, noticeable improvement in terms of processability is not observed.

Effects Regarding to Item (44)

In conventional photographic processing machines, in the fixing solution, ammonium salts are used as the main components of thiosulfate salt and sulfite salt, considering fixing property.

However, in the present invention, the processing solution is scattered (fed) in the air. Therefore, odor of ammonium becomes in question. However, by the use of sodium salt as the main component, ammonium odor can be avoided. In addition, in the case of sodium salt, dissolution from the film in the washing step or the stabilizing step when the light-sensitive material is conveyed outside the solutions is speedy. Therefore, from viewpoint of rapid washing of the light-sensitive material in each cation, the sodium salt is preferable.

DETAILED DESCRIPTION OF THE PREFERRED EMBODIMENT

Figure 1:
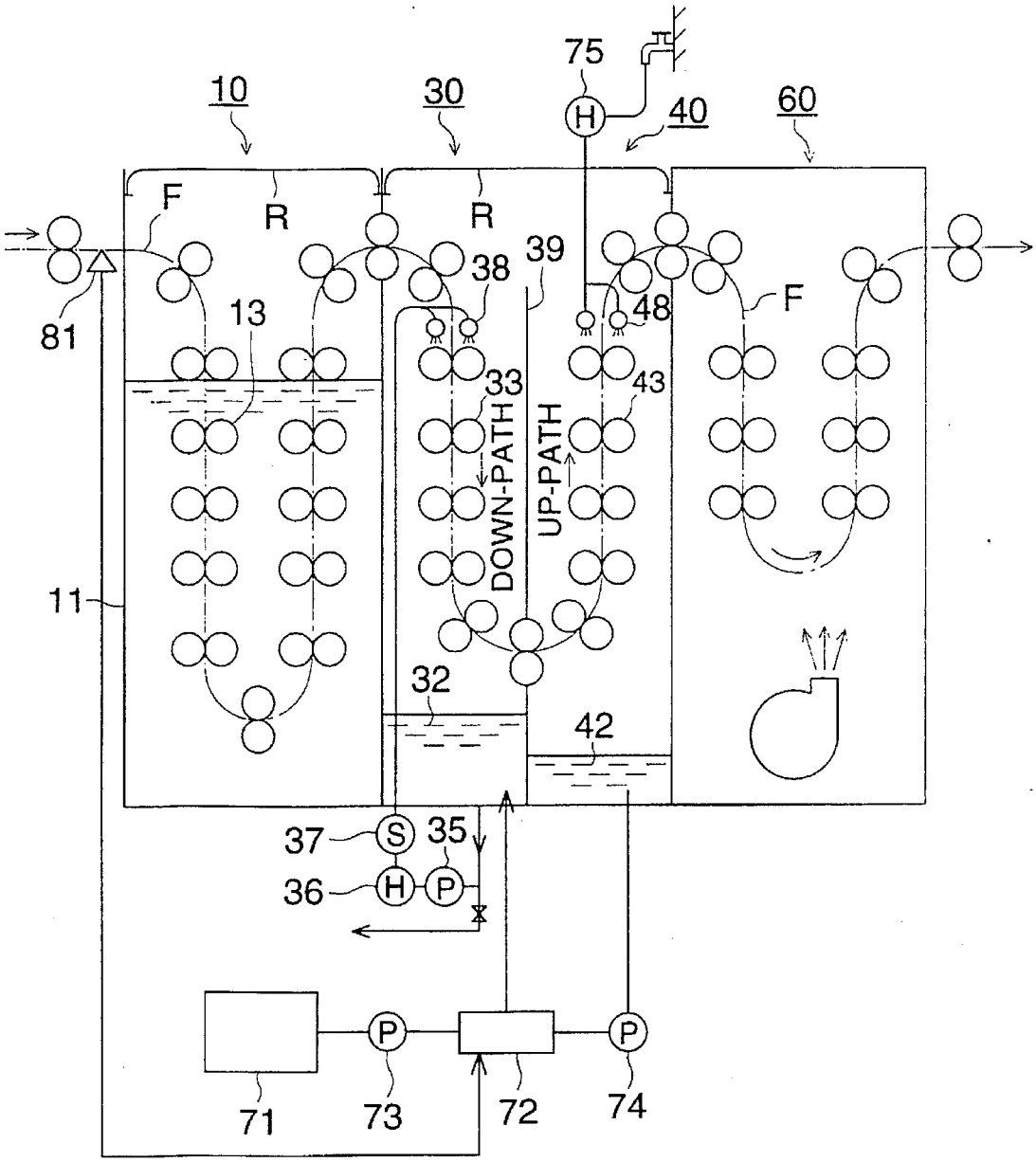
FIG. 1 is a side view showing the outline of an example of an automatic development processor of the present invention.

Referring to the drawings, examples of the present invention according to the above-described "Effect" will be described below. However, the present invention is not limited by the examples.

FIG. 1 is a side view showing an outline of an automatic development processor of the example written in items (1), (2), (5) to (20), and (44) to (57) of the present invention.

A development process 10 consists of an immersion processing type processor, including a developing tank 11 and a plurality of conveyance rollers 13, which is similar to a processor in the conventional immersion processing method. A fixing process 30 and a washing process 40 are included in a single processing tank, in which a down-path comprising a plurality of conveyance roller pairs 33 is used as a fixing process 30, and an up-path comprising a plurality of roller pairs 43, having the function of maintaining a processing solution, is used as a washing process 40. A fixing solution reservoir portion 32 and a washing water reservoir portion 42 are provided in the lower portion of each process. A temperature sensor 37 and a heater 36 are connected to the fixing solution reservoir portion 32, and the heated fixing solution is circulation-supplied by a pump 35 from a nozzle 38 provided in an upper portion of the down-path to a photosensitive material F.

When the fixing solution, which is the processing solution heated as described above, is circulation-supplied, rollers, processing solution maintaining member, or a processing solution impregnated in these units, are heated. As a heating means, the following is also possible: the rollers or a holding member, which have the processing solution maintaining function, are directly heated by a heater H, and the processing solution, in contact with the photosensitive material, is secondarily heated.

The rollers 43 in the up-path have the processing solution maintaining function, and city water is heated by the heater 75 and supplied to rollers 43, having the processing solution maintaining function, provided in the upper portion, and to the photosensitive material F, and is collected in the washing water reservoir portion 42 by its natural dropping. Further, a separation wall 39 is provided between a falling portion and a rising portion so that the solution is not splashed and mixed. Further, a replenishment control unit 72 conducts an operation command control for pumps 73 and 74 corresponding to the processing amount of photosensitive material, and water in the washing solution reservoir portion 42, and a concentrated fixing solution from a replenishment solution tank 71 for fixing solution are supplied to the fixing reservoir 32. A drying process 60 follows to the washing process 40, and the photosensitive material is dry-finished and collected.

In this connection, the processing amount of the photosensitive material is detected by a sensor 81, detecting the width and length of the photosensitive material, which is provided at a position to which the photosensitive material is sent, in an automatic development processor. This information is sent to the replenishment control unit 72, and the replenishment amount of the fixing solution is automatically adjusted by its command.

Although not shown in the drawings, the detected data is not only used to control the replenishment amount of the replenishment solution for the fixing solution, but also to control the replenishment amount of a stabilizing solution or the washing water. Further, in an automatic color development processor, which will be described in the following example, this data can also be used to control the replenishment amount for other processing solutions.

Also, when the normal-sized photosensitive material is processed, it can be processed by inputting a previously programmed appropriate replenishment amount, without depending on the information of the sensor 81.

Figure 2:
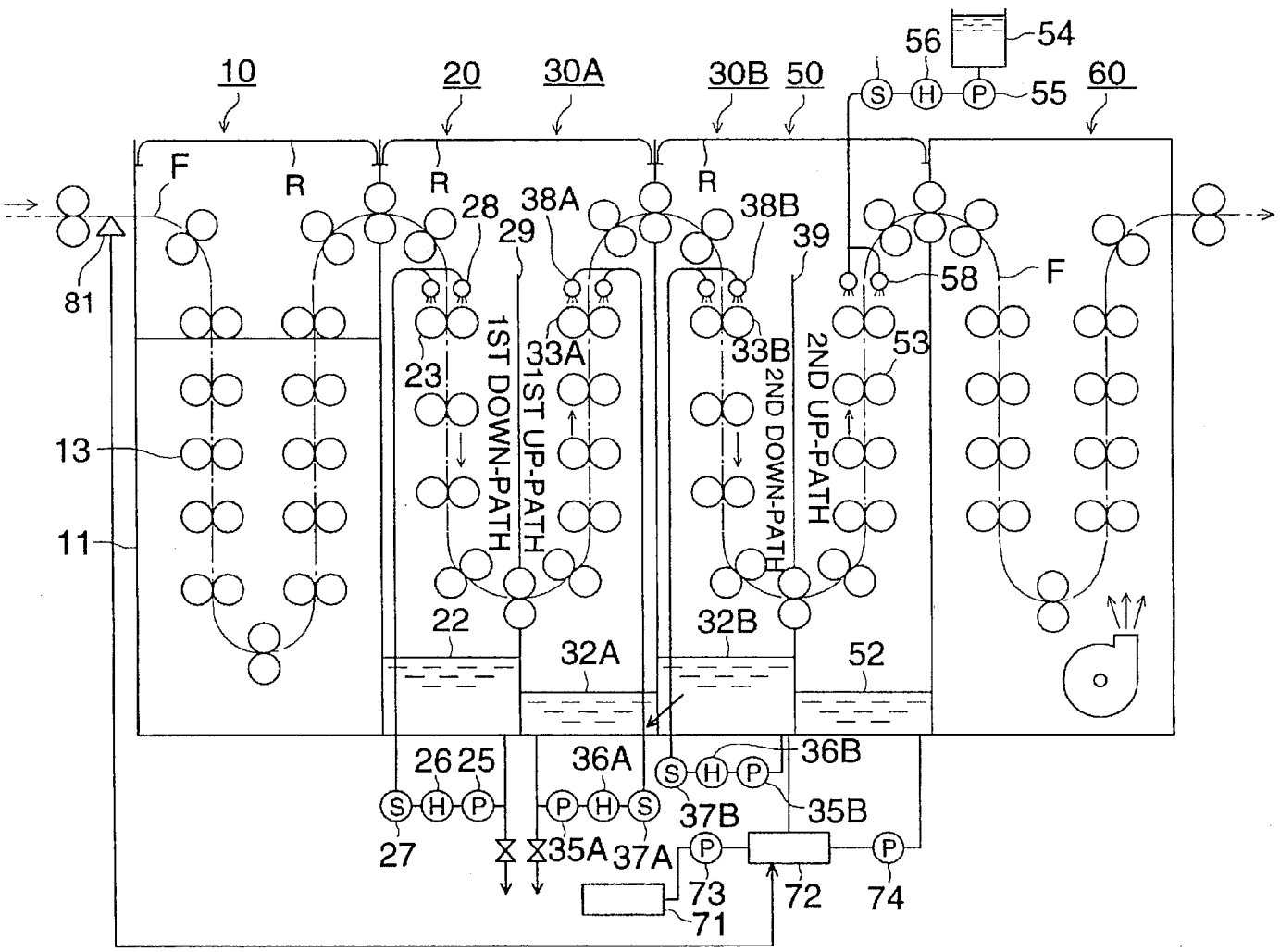
FIG. 2 is a side view showing the outline of an example of an automatic development processor of the present invention.

FIG. 2 is a side view showing an outline of an automatic development processor which is an example described in items (1), (2), and (21) to (57) of the present invention.

This is an example in which the present invention is applied to an automatic color development processor, and the development process 10 is similar to that of the immersion processing method shown in FIG. 1. The first down-path following the development process 10 is a bleaching process 20, the first up-path and the second down-path are respectively fixing processes 30A and 30B, the second up-path is a stabilizing process 50, and processing solution reservoirs are respectively provided in the lower portion of each process. Temperature sensors 27, 37A, 37B, and heaters 26, 36A and 36B are respectively connected to the bleaching solution reservoir 22, and two fixing solution reservoirs 32A and 32B. Nozzles 28, 38A, 38B are respectively arranged to face the photosensitive material F, which is positioned on upper rollers in each conveyance path, and each processing solution is circulation-supplied from each nozzle by pumps 25, 35A and 35B. Arrangement of the fixing process 30B of the second down-path and the stabilizing process 50 of the second up-path is the same as that of the example shown in FIG. 1, and rollers having the processing solution maintaining function are provided as rollers in the second up-path. The direction of flow of fixing solution reservoir portion 32A in the first up-path and that of the fixing solution reservoir portion 32B in the second down-path have a counter-flow relationship to each other. A new fixing solution is replenished into the fixing solution reservoir portion 32B in the second down-path, and the solution overflows into the fixing solution reservoir portion in the first up-path.

Rollers in the first up-path also have a processing solution maintaining function.

The stabilizing solution is supplied from a replenishing solution tank 54 by a pump 55. Temperature and the supply amount of the stabilizing solution are controlled by a temperature sensor 57 and a heater 56, and the stabilizing solution is supplied from a nozzle 58 provided in the upper portion of the tank to a roller 53 and the photosensitive material F in contact with the roller 53.

The stabilizing solution in the stabilizing solution reservoir portion 52 and the concentrated fixing solution from the replenishment solution tank for fixing solution 71 are supplied to the second fixing solution reservoir portion 32B, when the replenishment control unit 72 conducts a command, corresponding to the processing amount of the photosensitive material, for operating pumps 73 and 74.

The detection value of the sensor 81, or the program setting amount, which has been described above, is inputted into the replenishment control unit 72.

A drying process 60 follows to the stabilizing process 50, and the photosensitive materiel is dry-finished and collected.

In embodiments in FIGS. 1 and 2, as described above, a conventional immersion type tank is used for the development tank. Alternatively, a type which showers the development solution as the circulation processing solution onto the upper roller in an arrangement of roller pairs fitted with solution pans, may also be applied in the same manner as the above-described processing processes other than the development process.

Figure 3:
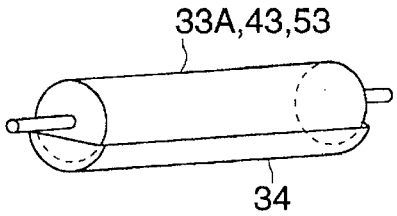
FIG. 3 is a perspective view of a roller having a processing solution maintaining function, and a solution pan, used in the present invention.
Figure 4:
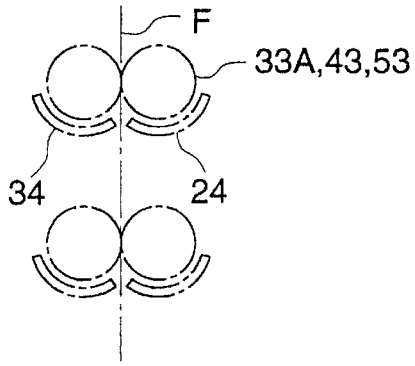
FIG. 4 is a front view of the roller having a processing solution maintaining function, and the solution pan, used in the present invention.

In an example of preferable arrangement of rollers 33A, 43, and 53, having the processing solution maintaining function, described in the items (3), (13), (24), (37), and (47), the rollers are provided with a solution pan 34 as shown by a perspective view in FIG. 3 and a front view in FIG. 4. Because its function and its effect have been described in the section "Effect", explanation will be omitted to avoid the duplication.

Because the preferable material for the example of rollers 33A, 43, and 53 in items (2), (12), (23), (36), and (46) has also been described in "Effect", the explanation will be omitted.

Figure 5:
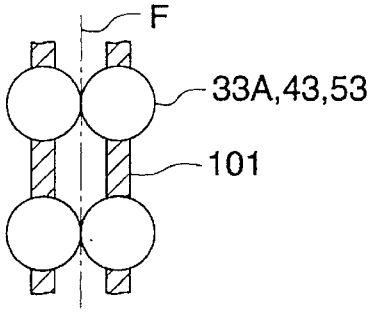
FIG. 5 is a front view of an example showing the relationship between a processing solution maintaining member and the roller, used in the present invention.
Figure 6:
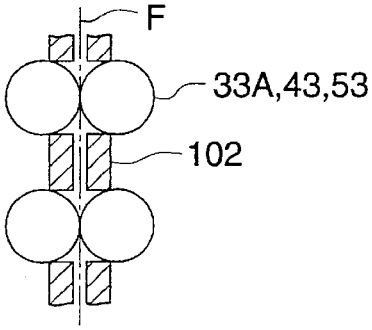
FIG. 6 is a front view of an example showing the relationship between a processing solution maintaining member and the roller, used in the present invention.

Next, examples of the arrangement of the processing solution maintaining member in items (4), (14), (25), (38), and (48) are as shown in front views in FIGS. 5 and 6.

In the arrangement shown in FIG. 5, the processing solution maintaining member 101 is not directly contacted with the photosensitive material, the processing solution maintaining member 101 contacts with the rollers 33A, 43, and 53, and the processing solution is supplied to the photosensitive material through the rollers. In the arrangement shown in FIG. 6, the processing solution maintaining member 102 directly contacts with the photosensitive material, and the processing solution is supplied to the photosensitive material. Rollers 33A, 43, and 53 mainly convey the photosensitive material upward and introduce the processing solution supplied from the upside so that the processing solution naturally falls downward.

Operations and advantages of this arrangement have been described in the section "Effect", and therefore, more detailed explanation will be omitted to avoid the duplication.

Figure 7:
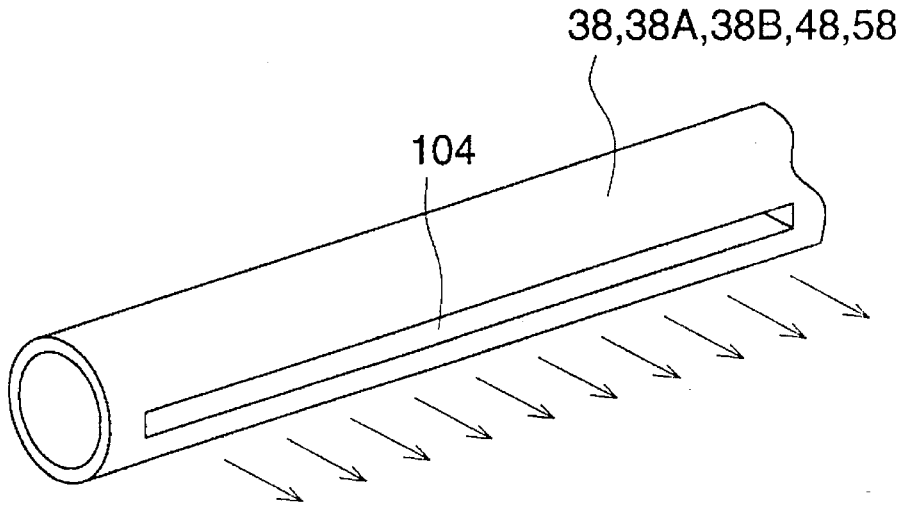
FIGS. 7(A) and 7(B) are perspective views of an example of a processing solution nozzle used in the present invention.
Figure 7:
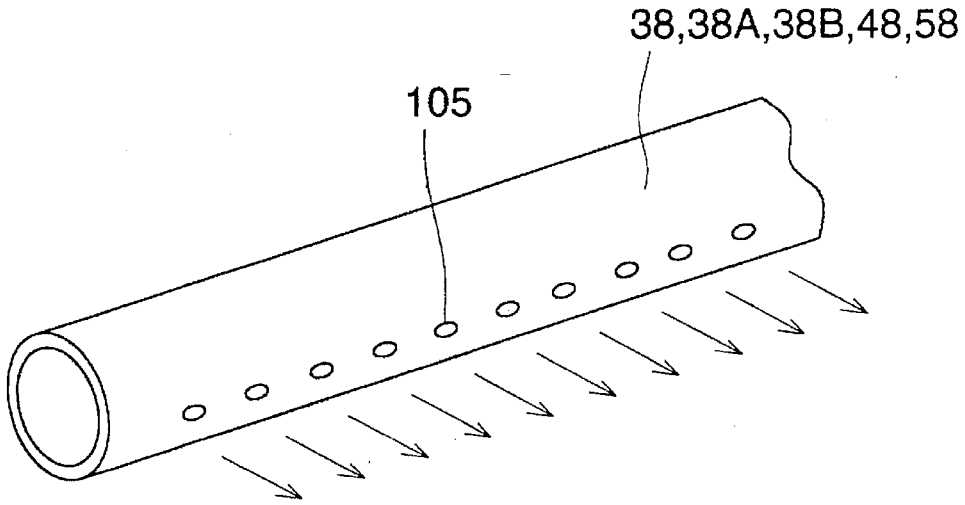

Next, an example of the arrangement of nozzles 38, 38A, 38B, 48, and 58 to circulate the processing solution, supply it from the upper portion of the conveyance path of the photosensitive material, and to supply a new solution of the processing solution, washing water, and stabilizing solution from the upper portion, has the structure shown in perspective views in FIGS. 7(A) and 7(B). In the structure shown in FIG. 7(A), the exit portion of the solution is a slit 104, and in the structure shown in FIG. 7(B), the exit of the solution is plural flow ports 105 which are arranged in one line or a zigzag line. In both structures, the processing solution can be uniformly supplied to the surface of the photosensitive material or the surface of upper rollers.

In this connection, as shown in FIGS. 1 and 2, the processing solution or washing water supplied from nozzles 28, 38, 36A, 38B, 48 and 58, provided above the roller pairs 23, 33, 33A, 33B, 43 and 53, (for a simplified description, only roller pairs 33 are taken as the representative example, and referred to as the roller pairs 33 hereinafter), is equally showered onto the roller pairs 33, and further, is stored in the solution pans 34 provided for each roller of the roller pairs 33; the solution or washing water is supplied onto the surface of the photosensitive material F, sandwiched and conveyed by the rollers, and used for processing; or the processing solution supplied from the rollers onto the photosensitive material F is conveyed to the lower roller or its solution pan 34; or the processing solution stored in the upper solution pan 34 overflows to the lower roller or its solution pan, and the processing solution is used for processing while being supplied onto the photosensitive material F conveyed from above by the lower rollers. In the embodiment of the invention of item 58, the development processing is performed by at least one of the above-described processing means.

Figure 8:
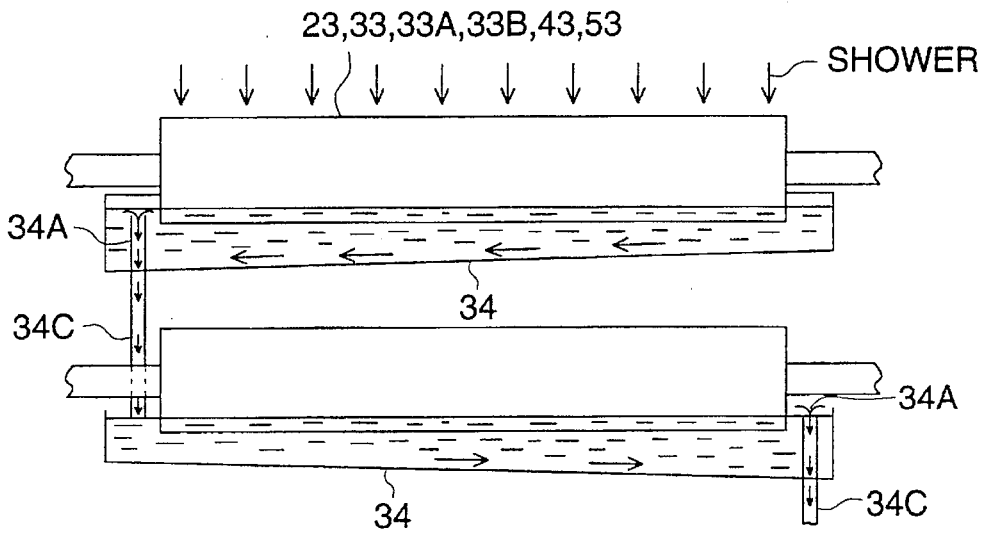
FIG. 8 is a frontal sectional view of an example of a roller pair having a solution pan.

Next, an embodiment of item 59 will be described using the front-sectional view of the roller pair with its solution pan, as shown in FIG. 8.

In FIG. 8, the bottom portion of the solution pan 34 is inclined with respect to the direction of the roller shaft. The processing solution, which falls and is supplied from above through the above-described path, flows smoothly in the direction of the roller shaft to an overflow exit 34A. During the above-described flow, the surface of the roller is immersed uniformly in the solution pan 34, so that the processing solution is equally supplied onto the photosensitive material F. The overflow processing solution flows into the lower solution pan from above through a pipe 34C. Although not shown in the drawings, the structure which causes the solution to flow from the center toward the ends, or the structure which causes the solution to flow in the direction of the roller shaft after the solution has dripped being divided into several portions, may be applied to this the embodiment. By this structure, the efficiency of processing-reaction of the photosensitive material F is increased and the washing efficiency of the photosensitive material and/or the conveyance path can also be enhanced.

Figure 9:
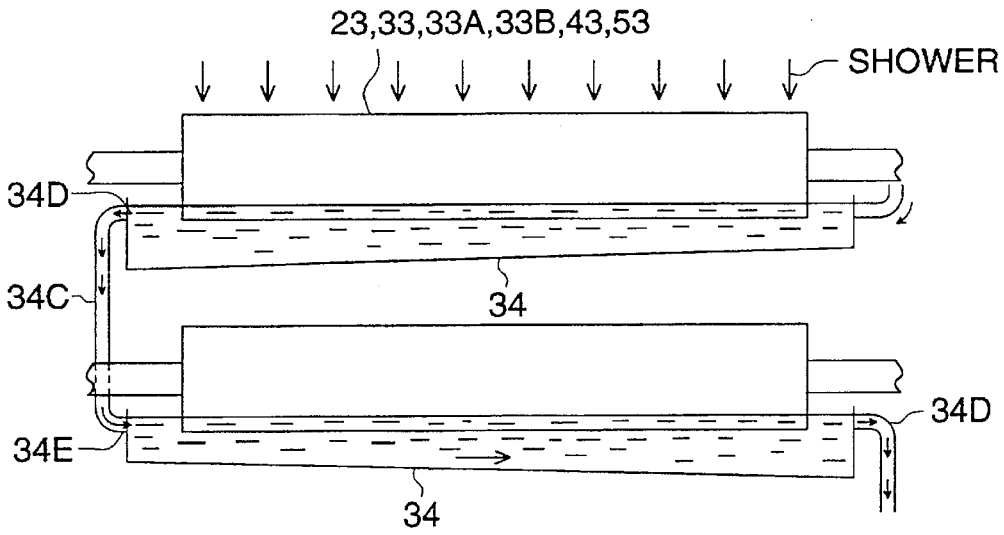
FIG. 9 is a frontal sectional view of another example of a roller pair having a solution pan.

In an embodiment of item 60, as shown in the front-sectional view of the roller pair 33 with its solution pan in FIG. 9, the overflow exit 34A described in the embodiment of item 2 is provided to the end portion of the solution pan 34 as shown by 34D. The overflowing processing solution flows into a solution supply inlet 34E provided to the end portion of the lower solution pan 34 through the pipe 34C. Further, by another overflow exit 34D, provided so that the processing solution flowing along the inclined surface of the bottom portion toward the opposite end, can overflow, the overflow solution flows into the solution supply inlet provided to a further lower solution pan 34. In this connection, the pipe 34C may be flexible hoses.

In this invention, the embodiment of item 59 is further advanced so that the processing reaction and the washing efficiency are further improved, and the overall production becomes easier.

Figure 10:
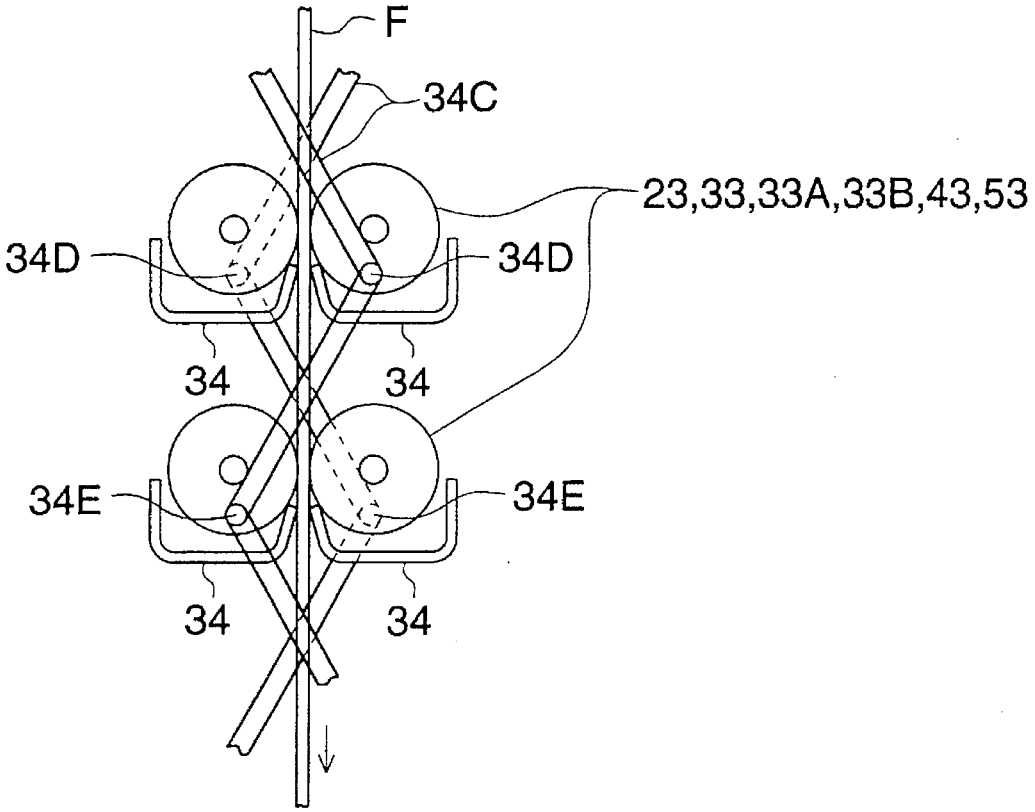
FIG. 10 is a side sectional view of the roller pair and overflow pipes of its solution pan.

Next, an embodiment of item 61 will be described using the side-sectional view of the roller pair and its solution pan shown in FIG. 10.

In the embodiment of item 60, when the processing solution supplied into the solution pan 34 provided for one roller of the roller pair 33 overflows from the overflow exit 34D into the solution supply inlet 34E provided to the lower solution pan 34, the overflow solution is caused to further flow into another solution pan 34 provided just below another roller of the roller pair 33, not into the solution pan 34 provided just below the one roller, that is, into the lower solution pan 34 provided diagonally below the one roller. By the structure described above, the overflow pipes 34C toward the front and rear solution pans arranged in the up-path or the down-path, are arranged alternately and connected. Thereby, when both surfaces of the photosensitive material such as X-ray film, are processed, the processing solution is supplied simultaneously onto both surfaces of the photosensitive material F, and an effect in which the supply amount becomes more equal, is obtained.

Further, equal processing reaction advances simultaneously on the front and the rear surfaces, and washing is performed uniformly when the conveyed portion for the photosensitive material F is washed, resulting in good maintenance of the finishing quality of the processing.

Next, an embodiment of item 62 will be explained by using a side-sectional view of the roller pair and its solution pan shown in FIG. 11.

Figure 11:
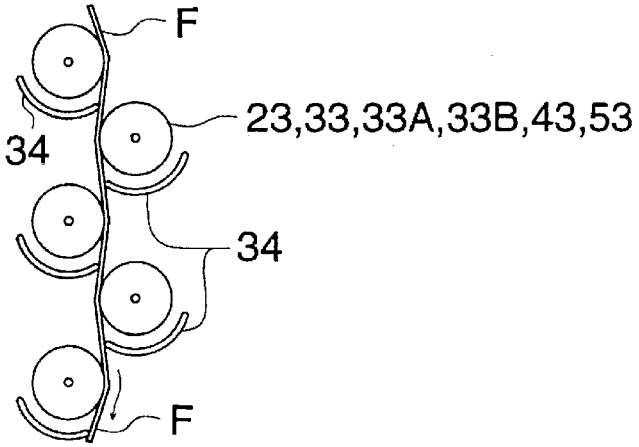
FIG. 11 is a side sectional view of the rollers arranged zigzag and their solution pans.

In FIG. 11, plural sets of the roller 33 and its solution pan 34 are arranged zigzag on both sides of the vertically conveyed photosensitive material F. In this structure, the adjoining rollers, sandwiching the photosensitive material, attribute to the conveyance of the photosensitive material as a pair of rollers.

If light-sensitive material F tends to be scratched by providing the above-mentioned arrangement, favorable quality can be resulted in by adopting a stiff substrate having little flexibility.

Figure 12:
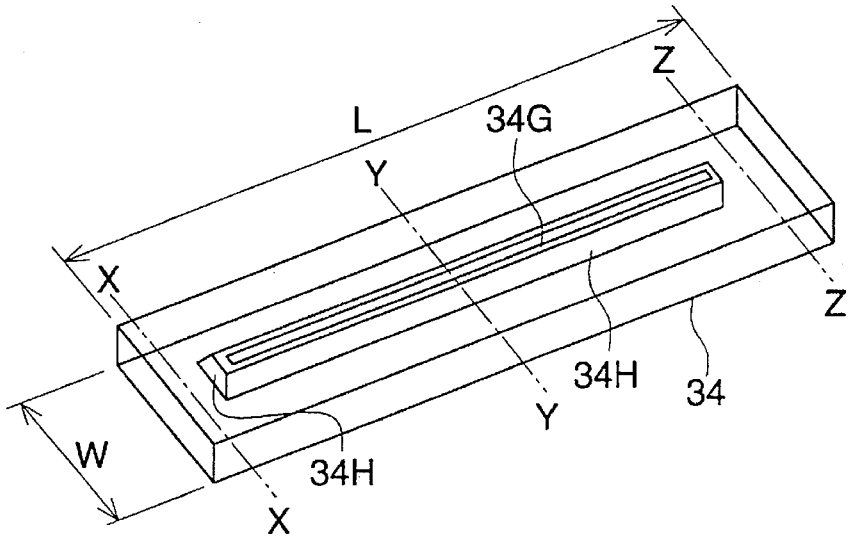
FIGS. 12(*a*), 12(*b*), and 12(*c*) are a perspective view of an integrated solution pan and its sectional views.
Figure 12:
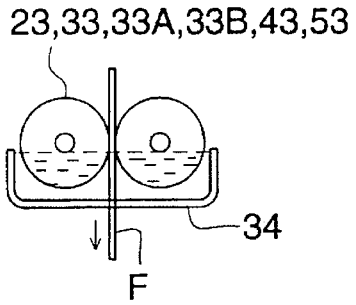
Figure 12:
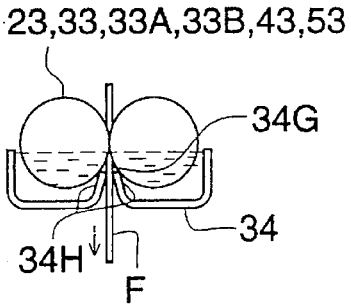

As shown in FIG. 12 (*a*) (a perspective view of a solution reservior), FIG. 12(*b*) (an end view of its X—X plane and Z—Z plane) and FIG. 12 (*c*) (an end view of its Y—Y plane), the embodiment of item 63 arranges that solution reservior 34 for paired roller 33 used not used for each roller but used for both rollers. For this purpose, the center of the reservior was swollen from the bottom thereof by means of dike 34H and slit window 34G through which light-sensitive material passes was opened at the center of the swollen upper surface.

Due to the above-mentioned structure, solution reservior 34 includes each roller of paired rollers 33. Accordingly, it is possible to halve the number of member. The machine is simplified and manufacturing cost therefor can be reduced.

Figure 13:
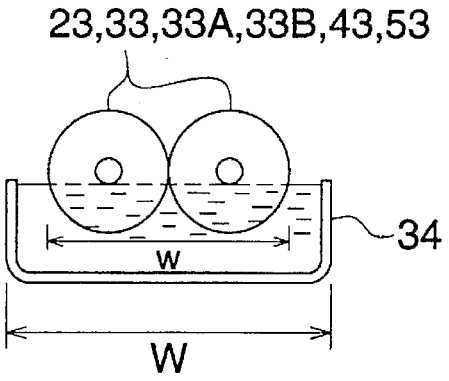
FIGS. 13(*a*) and 13(*b*) are a side sectional view and a frontal sectional view of the roller pair and the solution pan surrounding the roller pair.
Figure 13:
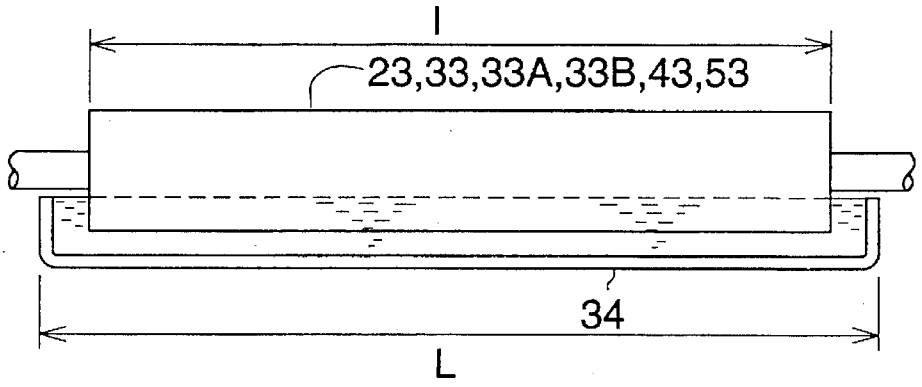

As shown in FIG. 13 (*a*) (the side cross sectional view of paired rollers a solution reservior therefor) and FIG. 13 (*b*) (a from cross sectional view), the embodiment of item 64 is that the upper rollers can receive all processing solution falling from light-sensitive material F by arranging shaft direction length l and width w of paired rollers 33 to be respectively shorter than the length L and width W of the solution reservior 34. Due to this structure, multi-step counter flow formed on the up-path of the above-mentioned light-sensitive material and multi-step ordinary flow formed on the down-path of light-sensitive material F can effectively function. Specifically, in accordance with the form of multi-step counter flow, rapid processing can be realized.

As previously described utilizing side cross sectional views in FIGS. 1 and 2, the embodiment of item 65 is to conduct accurate heating and temperature-adjusting including the temperature of air in the tanks effectively with little energy by providing heating and temperature-adjusting means in a circulation path which feeds the processing solution from the storage tank of the processing solution to the paired rollers and/or the solution reservoirs and inside the solution reservoirs to which the processing solution is fed and by providing lid R above the above-mentioned processing sections (developing step 10, fixing step 30 and washing step 40) so that each section is to be substantially tightly closed. Due to the above-mentioned structure, stable processing performance can be attained in terms of light-sensitive material finish-processing.

In an embodiment of item 66, at least one roller of the roller pair 33 immersed in the solution pan 34 is a drive roller, and the roller is driven for a predetermined period of time per a predetermined time even during non-operation of the apparatus. When unimmersed portions of the roller contact ambient air and this condition is maintained for a long period of time, staining of the roller is caused. However, as in the embodiment, when the roller is rotated at appropriate timing, the phenomena of the roller stain is avoided. As a preferable intermittent drive control, the roller is controlled to be driven for 2–60 seconds every 5–60 minutes even during the non-operation of the apparatus.

In this connection, the automatic development processor shown in FIG. 1, can development-process each type of photosensitive material when the processing solution in each process is selected as follows:

| | 1st process | | 2nd process | | 3rd process | | 4th process |
|---|---|---|---|---|---|---|---|
| Color paper: | color developer | → | bleach and fix solution | → | stabilizing solution | → | drying |
| Printing film, X-ray film: | developing solution | → | fixing solution | → | washing water | → | drying |

Figure 14:
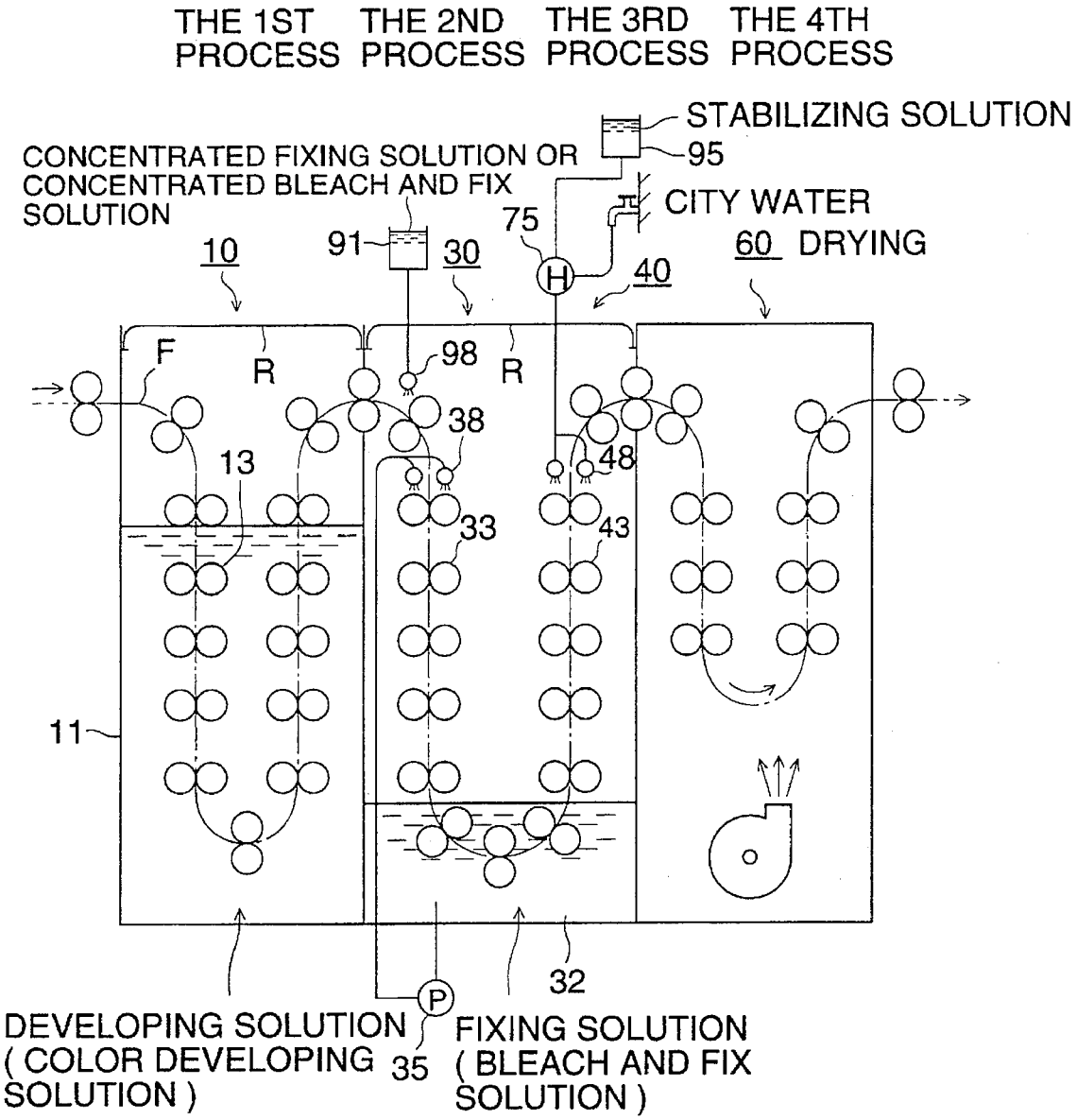
FIG. 14 is a side sectional view of an example of the automatic development processor of the present invention.

A side view showing the outline structure in FIG. 14, shows that the multi-function processing, described above, can be performed. FIG. 14 also shows that a separation wall between the fixing process or the bleaching and fixing process, which is the 2nd process, and the washing process or the stabilizing solution process, which is the 3rd process, can be removed to reduce the weight and to simplify the structure of the development processor. That is, each circulation processing solution, concentrated processing solution, city water, or stabilizing solution as a new solution from the upside, or the circulation processing solution from the reservoir 32, provided in the lower portion, is supplied by an appropriate amount which is near the required minimum amount. Accordingly, the processing solution in the lower reservoir 32, is the constantly appropriate fixing solution or bleach and fix solution, and does not spatter to the circumference of the development processor, so that the solution can efficiently be in contact with the photosensitive material.

The fixing solution or the bleach and fix solution in the processing solution reservoir 32 in the lower portion is always maintained to have appropriate concentration, and is sprayed and circulated by a pump.

A new solution of the fixing solution or the bleach and fix solution, is appropriately supplied through the nozzle 98 from the replenishment tank 91 in the upper portion.

When the washing water is used, an appropriate amount of city water is supplied in the same manner as shown in FIG. 1. When the stabilizing solution is used, the solution is appropriately heated by a heater 75, while it flows from a stabilizing solution replenishment tank 95, provided in the upper portion, through the heater 75, and flows from a nozzle 48 into the processing tank.

In this connection, although it is preferable that a temperature sensor and a heater are provided together with a pump in each circulation path as shown in FIG. 1, only a portion of those units is shown in FIG. 14.

Figure 15:
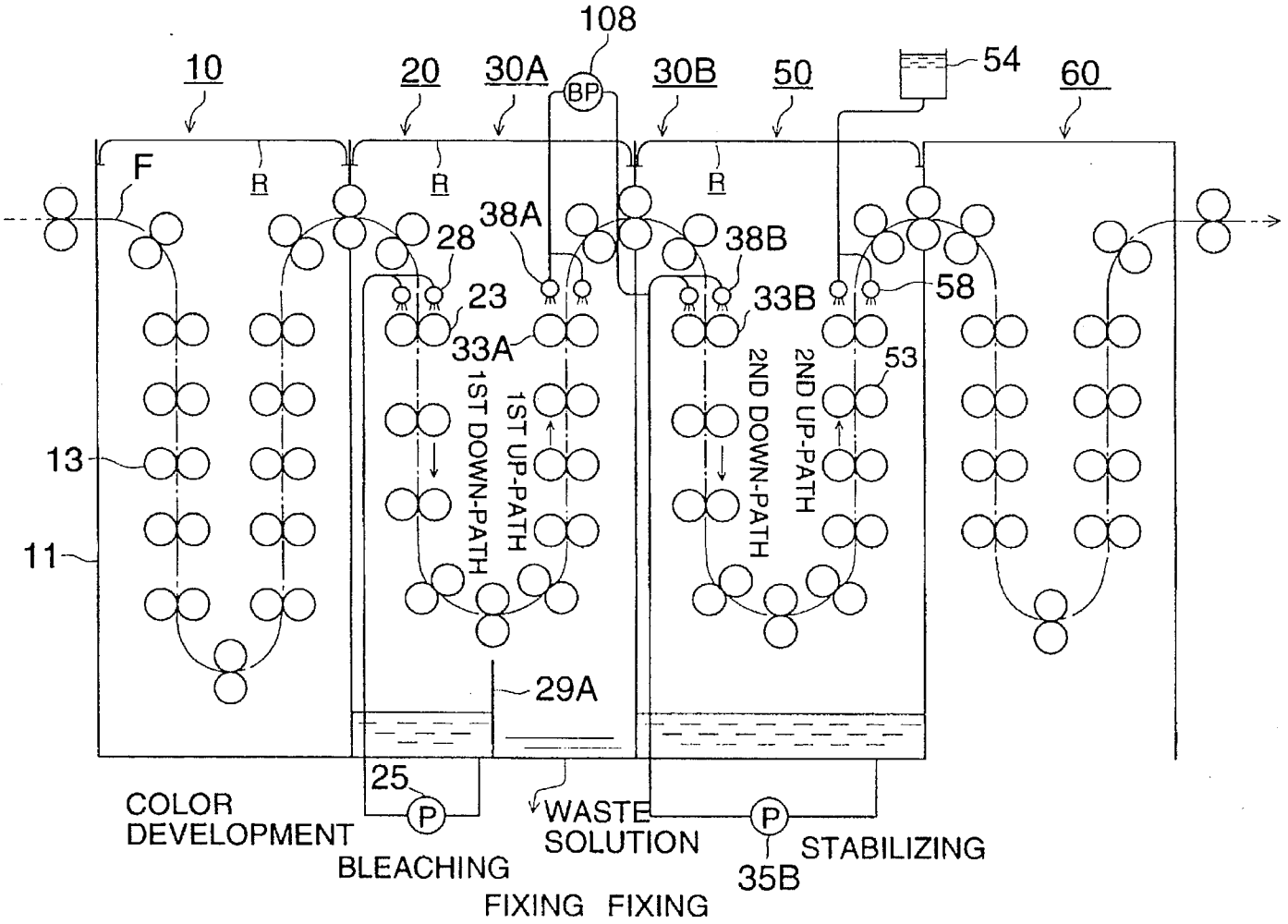
FIG. 15 is a side sectional view of an example of the automatic development processor of the present invention.

A side view showing the outline structure in FIG. 15, represents an example of the automatic development processor for color film, and is a view showing the more simplified automatic development processor shown in FIG. 2, which is an example described mainly in the item 44.

In this example, most of the separation wall 29 provided between the first down-path and the first up-path shown in FIG. 2 is removed, and the lower portion of the separation wall remains as a separation wall 29A for the bleaching solution reservoir 22 in the lower portion. Further, the separation wall 39 provided between the second down-path and the second up-path is completely removed.

The stabilizing solution, which is supplied from a stabilizing solution replenishment tank 54, and which counter-flows down while being in contact with a roller 53, having the processing agent maintaining function, in the second up-path, and the photosensitive material F, is mixed with and stored in the fixing solution in the fixing solution reservoir portion without being independently stored in the lower portion. Then, the stabilizing solution is maintained with the appropriate concentration as a dilution solution for the fixing solution, together with a new solution of the fixing solution separately supplied periodically. The solution is supplied, with circulation using a pump 35B, onto the surface of the conveyed photosensitive material by a nozzle 38B from the upper portion of the second down-path. Simultaneously, the fixing solution, which is a branched portion from the circulation path, is supplied from a nozzle 38A by a predetermined amount by a constant amount pump 108 in the upper portion, and is in contact, in the status of counter flow, with a roller 33A having the processing agent maintaining function in the upper portion, or the photosensitive material F conveyed upward by the roller 33A. Then, the fixing solution gradually flows downward, and it is considered that the solution is exhausted to almost the limit when the solution reaches the reservoir in the lower portion. Accordingly, the solution is disposed as a waste solution.

These processing solutions are efficiently supplied by the required amount from the nozzles 28, 38A, 38B, and 58 and do not spatter. These solutions flow down gently while being impregnated in each roller, the photosensitive material, or the processing agent maintaining member, not shown in the drawing or described in another example, and therefore, it can be considered that the removal of the separation walls 29 and 39 hardly causes any problems.

As an example in items (20) and (33), a simple cover R is provided independently or integrally with the adjoining tank, on the upper portion of each processing tank. This cover is provided to prevent the gas in the tank from being replaced with the air, and is intended to prevent the smell generated by high temperature processing of the processing solution. However, the smell is only slightly generated when the fixing solution described in the item (57) is used. Accordingly, the pseudo-closed structure is sufficient for the above purpose.

Figure 16:
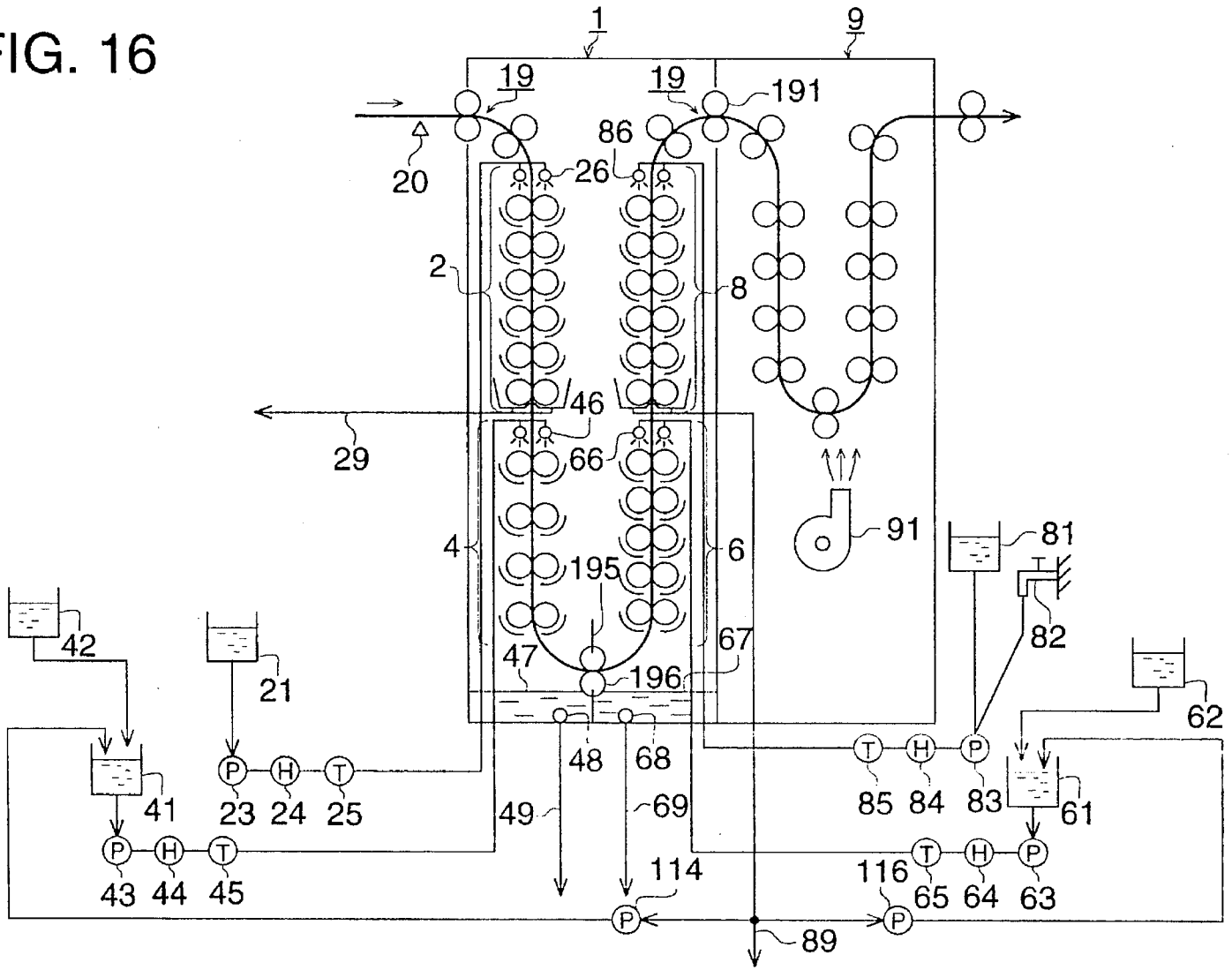
FIG. 16 is a side sectional view of an example of the automatic development processor of the present invention.
Figure 17:
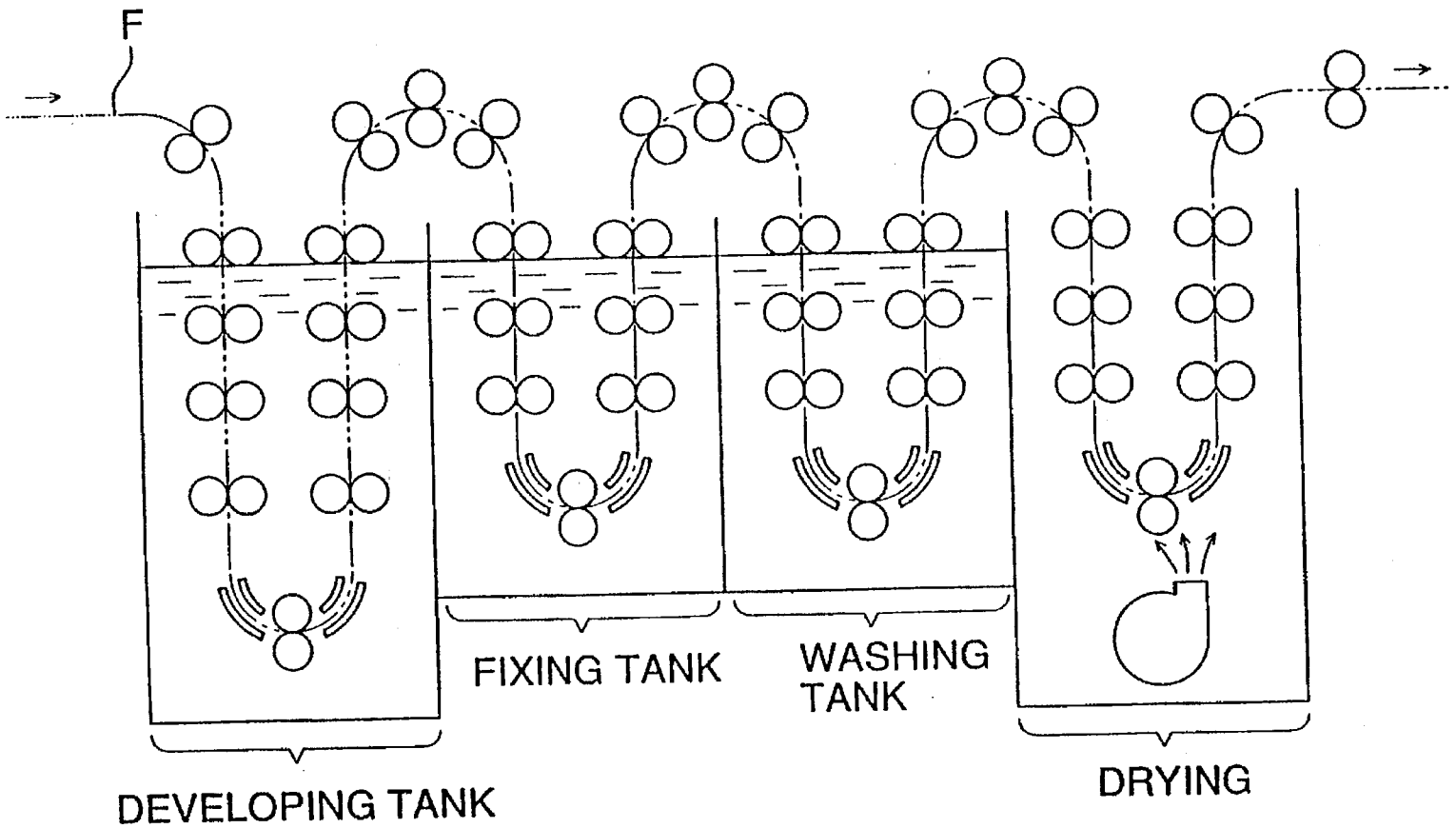
FIG. 17 PRIOR ART
FIG. 17 is a side sectional view of the conventional automatic development processor for the photographic photosensitive material.
Figure 18:
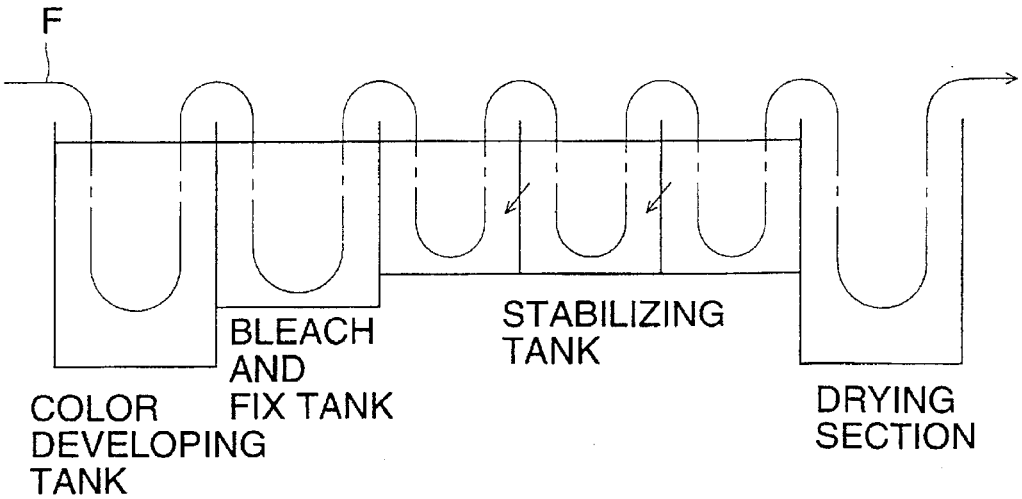
FIG. 18 PRIOR ART
FIG. 18 is a side sectional view of the conventional multi-step counter flow type automatic development processor for the photographic photosensitive material.
Figure 19:
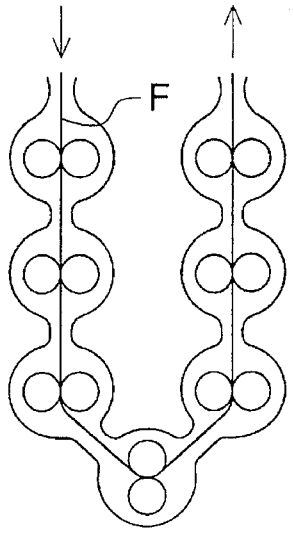
FIG. 19 PRIOR ART
FIG. 19 is a partial side sectional view showing an example of the conventional small volume processing tank.

Next, an example shown in FIG. 16 will be explained. An automatic development processor in the example consists of: a color development processing process 2 in which printing paper is color development processed by a color development solution stored in a color development solution reservoir section 27; a bleaching processing process 4 which bleaching-processes the printing paper, developed in the color development processing process 2, by a bleaching solution; a fixing processing process 6 which fixing-processes the printing paper, bleaching-processed in the bleaching processing process 4, by a fixing solution; a washing processing process 8 which washing-processes the printing paper, fixing-processed in the fixing processing process 6, by washing water; and a dry processing process 9 which dries the washing-processed printing paper.

Then, the photosensitive material detection sensor 20 provided at the entrance for the printing paper detects the passage of the printing paper in front of this sensor. The time of the passage of the printing paper is determined in each processing process according to the time of the passage of the printing paper detected by the photosensitive material detection sensor 20. Further, the amount of processed printing paper is computed from the total of the passing time of the printing paper, detected by the photosensitive material detection sensor 20.

In this automatic development processor, the dry processing process 9 is processed by dry hot air by a commercial conventional dry hot air fan 91. The automatic development processor has a feature in which the color development processing process 2, bleaching processing process 4, fixing processing process 6 and washing processing process 8 are included in a single processing tank 1, having a pseudo sealed structure. Further, the automatic development processor is provided with a roller transportation type conveyance method in which the printing paper is pinched and conveyed by plural conveyance roller pairs. A down-path from top to bottom, and the up-path from bottom to top are provided in the processing tank 1 having the pseudo sealed structure, as conveyance paths for the printing paper conveyed by the conveyance roller pairs. The bleaching processing process 4 and the fixing processing process 6 are provided in the down-path. Thereby, the required area for mounting the automatic development processor can be decreased, and therefore the overall size of the automatic development processor can also be decreased. A curved conveyance path 197 following to the down-conveyance path, and the up-conveyance path following the curved conveyance path 197 are provided in the processing tank 1 having the pseudo sealed structure. The washing processing process 8 which washing-processes the printing paper is provided in the up-conveyance path. Thereby, the area required for mounting the automatic development processor can be further decreased.

Further, the down-conveyance path having the color development processing process 2 and the bleaching processing process 4, the curved conveyance path, and the up-conveyance path having the fixing processing process 6 and the washing processing process 8 are provided in the processing tank 1 with the pseudo sealed structure. Because the washing processing process 8 is provided in The processing tank 1 with the pseudo sealed structure, the water evaporation from the processing solution in the color development processing process 2, bleaching processing process 4 and fixing processing process 6, can be prevented, and the crystallization of solids due to water evaporation in the bleaching processing process 4 and the fixing processing process 6 can also be prevented, resulting in a decrease of the frequency of maintenance operations in the various processing processes. Accordingly, although the processing tank 1 with the pseudo sealed structure is mounted in a narrow space highly densely, the ease of maintenance of the entire operation can be improved.

The color development processing process 2, bleaching processing process 4, fixing processing process 6 and washing processing process 8, provided in the processing tank 1 with the pseudo sealed structure, have a plurality of solution pans incorporated with conveyance roller pairs. Each process is structured such that the processing solution naturally falls from the adjacent higher solution pan to the next lower solution pan in the same processing process. A supply pipe to supply the processing solution to the uppermost solution pan in the same processing process is provided in each process. That is, in the color development processing process 2, the color development solution is supplied from a color development solution supply pipe 26 to the uppermost solution pan in the color development processing process 2. In the bleaching processing process 4, the bleaching solution is supplied from a bleaching solution supply pipe 46 to the uppermost solution pan in the bleaching processing process 4. In the fixing processing process 6, the fixing solution is supplied from a fixing solution supply pipe 66 to the uppermost solution pan in the fixing processing process 6, and in the washing processing process 8, the washing water is supplied from a washing water supply pipe 86 to the uppermost solution pan in the washing processing process 8. Thereby, because only supply of the processing solution to each solution pan close to the conveyance roller pairs and the supply to the printing paper are necessary, the total amount of processing solutions can be decreased.

Further, in the color development processing process 2 and the bleaching processing process 4, because the processing solution is supplied from the upper solution pan to the printing paper, and then, the processing solution is supplied from the lower solution pan to the printing paper, the condition of flow is a normal multi-step flow having the number of processing steps equal to the number of solution pans. In the upper solution pan, the concentration of reaction components of the processing solution becomes high, and the solution has smaller elution and is highly active. Further, the reaction efficiency is enhanced, resulting in quicker overall processing and a reduction of the overall size of the apparatus.

Further, in the fixing processing process 6 and the washing processing process 8, because the processing solution is supplied from the lower solution pan onto the printing paper, and then, the processing solution is supplied from the upper solution pan onto the printing paper, the solution flow is under the condition of a multi-step counter flow processing having the number of processing steps equal to the number of solution pans. Thereby, specifically in the washing processing process 8, the higher the position of the upper solution pan is, the fresher the washing water becomes, resulting in enhancement of the washing processing efficiency.

In the bleaching processing process 4, the bleaching solution is supplied from a bleaching solution tank 41 to the bleaching solution supply pipe 46 by a bleaching solution supply pump 43, for a predetermined period of time of Tb3 at every predetermined time interval Tb2 after the passing time of the printing paper in the bleaching processing process 4, obtained from the passing time of the printing paper detected by the photosensitive material detection sensor 20, a predetermined time Tb1 before and after the above-described passing time, and the passing time of the printing paper just before in the bleaching processing process 4. In this case, the bleaching solution passes sequentially through the bleaching solution tank 41, the bleaching solution supply pump 43, a portion incorporating a bleaching solution heater 44, and the portion incorporating a bleaching solution thermometer 45, and arrives at the bleaching solution supply pipe 46. Here, the bleaching solution heater 44 heats the bleaching solution, and the bleaching solution thermometer 45 measures the temperature of the heated bleaching solution. Heating of the bleaching solution by the bleaching solution heater 44 is controlled so that the temperature of the heated bleaching solution equals a predetermined temperature Teb, by the control in combination of the feed-forward control and the feedback control, based on the temperature of the bleaching solution measured by the bleaching solution thermometer 45 and the temperature of water measured by a water thermometer provided in the bleaching tank 41, not shown in the drawings. When the amount of solution in the bleaching solution tank 41 is reduced, a predetermined amount jb of bleaching solution replenishment agent is supplied from a bleaching solution replenishment agent container 42, and a predetermined amount Qb of waste washing water is supplied from a washing water delivery pipe 89 by a bleaching solution replenishment water pump 114.

In the fixing processing process 4, the fixing solution is supplied from a fixing solution tank 61 to the fixing solution supply pipe 66 by a fixing solution supply pump 43, for a predetermined period of time of Tf3 at every predetermined time interval Tf2 after the passing time of the printing paper in the fixing processing process 6, obtained from the passing time of the printing paper detected by the photosensitive material detection sensor 20, a predetermined time Tf1 before and after the above-described passing time, and the passing time of the printing paper just before in the fixing processing process 6. In this case, the fixing solution passes sequentially from the fixing solution tank 61, through the fixing solution supply pump 63, a portion incorporating a fixing solution heater 64, and the portion incorporating a fixing solution thermometer 65, and arrives at the fixing solution supply pipe 66. Here, the fixing solution heater 64 heats the fixing solution, and the fixing solution thermometer 65 measures the temperature of the heated fixing solution. Heating of the fixing solution by the fixing solution heater 64 is controlled so that the temperature of the heated fixing solution equals a predetermined temperature TEf, by the control in combination of the feed-forward control and the feedback control, based on the temperature of the fixing solution measured by the fixing solution thermometer 65 and the temperature of water measured by a water thermometer provided in the fixing tank 61, not shown in the drawings. When the amount of solution in the fixing solution tank 61 is reduced, a predetermined amount jf of a fixing solution replenishment agent is supplied from a fixing solution replenishment agent container 62, and a predetermined amount Qf of waste washing water is supplied from a washing water delivery pipe 89 by a fixing solution replenishment water pump 116.

In this connection, TEd, TEb, TEf and TEw may or may not be equal to each other, and each temperature is preferably set appropriately. Further, it is preferable that Jb and Jf, and Qb and Qf are appropriately set respectively.

As described above, pure new processing solution which has not previously been used for processing of the printing paper, is supplied in each of the color development processing process 2, bleaching processing process 4, fixing processing process 6 and washing processing process 8, and thereby, the overall reaction efficiency is increased. Specifically, in the color development processing process 2 and the bleaching processing process 4, the processing is clearly under the condition of normal multi-step flow having the number of processing steps equal to the number of solution pans. In the first solution pan, the concentration of reaction components of the processing solution is highest, and the solution has low elution and is highly active, and the conspicuous effect in which the reaction efficiency is increased, is obtained. Thereby, quicker processing and overall size reduction of the apparatus can be realized.

Further, in order to eject the color development solution used for processing, a delivery pan, which is a solution pan of the lowermost conveyance roller pair, is provided below the lowermost conveyance roller pair in the color development processing process 2. The color development solution which has been used for processing is delivered from the color development solution delivery exit 28 of the delivery pan by the color development solution delivery pipe 29. Thereby, contamination of the bleaching processing process 4, which is the following process of the color development process, can be greatly decreased, and the high processing activity of the following bleaching processing process 4 can be maintained. Further, effects in which the reaction efficiency is increased due to the application of the new solution supplying method for the fixing processing process 6, and effects in which quicker processing and overall size reduction of the apparatus can be realized, are greatly enhanced.

The conveyance roller pairs in the down-conveyance path from top to bottom, are provided at equal intervals to other pairs. (In the drawing, intervals of these rollers are not equal so that the delivery pan and the supply pipe can be more clearly shown.) Members to support the delivery pan and the bleaching solution supply pipe 46 in the color development processing process 2 are provided between conveyance roller pairs in the down-conveyance path. Position s of the delivery pan and the bleaching solution supply pipe 46 in the color development processing process 2 can be changed in the down-conveyance path. Thereby, the processing path can be changed by changing these positions, and processing can be carried out even when the processing process is different due to the type of printing paper, the type of processing solution, or the like.

Further, a delivery pan, which is the solution pan of the lowermost conveyance roller pair, is provided to deliver the washing water which has been used for processing below the lowermost conveyance roller pair in the washing processing process 8, and the washing water used for the processing is delivered from a washing water delivery exit 88 of the delivery pan by a washing water delivery pipe 89. Thereby, the amount of the washing water entering into the fixing processing process 6, which is a lower process for the washing water, can be greatly decreased, and the concentration of the solution in the fixing processing process 6 can be maintained at higher levels. Further, effects in which the reaction efficiency is increased due to the application of the new solution supply method for the fixing processing process 6, and effects in which quicker processing and overall size reduction of the apparatus can be realized, are further enhanced.

The conveyance roller pairs in the up-conveyance path from bottom to top, are provided at equal intervals to other pairs. (in the drawing, the interval of these rollers is not equal to more clearly show the delivery pan and the supply pipe.) Members to support the delivery pan and the fixing solution supply pipe 66 in the washing processing process 8 are provided between the conveyance roller pairs in the up-conveyance path. Position of the delivery pan and the fixing solution supply pipe 66 in the washing processing process 8 can be changed in the up-conveyance path.

Thereby, the processing path can be changed by changing these positions, and the invention can cope with the differences of the processing process due to the type of printing paper, the type of processing solution, or the like.

In the lower portion of the bleaching processing process 4, a bleaching solution reservoir portion 47 is provided below the curved conveyance path 197. The bleaching solution used in the bleaching processing process 4 drips into the bleaching solution reservoir portion 47. A bleaching solution delivery exit 48 is provided at a predetermined height in the bleaching solution reservoir portion 47 so that the solution stored in the bleaching solution reservoir portion 47 does not exceed a predetermined level.

In the lower portion of the fixing processing process 6, a fixing solution reservoir portion 67 is provided below the curved conveyance path 197. The fixing solution used in the fixing processing process 6 falls into the fixing solution reservoir portion 67. A fixing solution delivery exit 68 is provided at a predetermined height in the fixing solution reservoir portion 67 so that the solution stored in the fixing solution reservoir portion 67 does not exceed a predetermined level.

Thereby, humidity in the processing tank 1, having the pseudo sealed structure, can be maintained at a high level, and dissolved materials in the processing solution are prevented from crystallizing due to evaporation of the processing solution in the processing tank 1.

Conventionally, in the automatic development processor for printing paper, the overall size of the automatic development processor is decreased by providing the bleach-fixing processing process which is integrated with the bleaching processing process and fixing processing process. However, conversely in this automatic developing processor, the bleaching processing process 4 and the fixing processing process 6 under the bleaching processing process 4, are provided separately from each other. Thereby, the performance of the bleaching solution and that of the fixing solution are independently exerted; the bleaching solution and the fixing solution having higher reaction properties which can not be achieved with conventional bleach-fixing solutions, can also be used; and the reaction efficiency of the processing solution on the printing paper is enhanced, so that quicker processing can be realized. Because the bleaching solution naturally falls from top to bottom in the bleaching processing process 4, the bleaching solution consumes oxides in air such as oxygen in the processing tank 1. Accordingly, the bleaching solution becomes more active, and deterioration by oxidation of other processing solutions in the processing tank 1 can be prevented.

A delivery pan 14 provided below the lowermost conveyance roller pair in the bleaching processing process 4, to deliver the bleaching solution used for processing, has the same structure as the delivery pan 14 in the bleaching processing process 4 in embodiment 1.

Further, the delivery pan 14 is provided at a position in which the lowermost conveyance roller 12 in the bleaching processing process 4 is immersed in the bleaching solution so that the position of the delivery pan 14 can be changed in the down-conveyance path.

In the case of color photographic photosensitive material, the following processes can be listed as embodiments in which plural types of processing processes are provided in a single down-conveyance path in the plural conveyance paths, however, the present invention is not limited by these embodiments. In the following processes, the direction of conveyance is sequentially shown from left to right.

(1) Bleaching processing process→fixing processing process
(2) Washing processing process→fixing processing process
(3) Bleaching processing process→washing processing process
(4) Bleaching processing process→washing processing process→fixing processing process
(5) Washing processing process→bleaching processing process→fixing processing process
(6) Washing processing process→bleach-fixing processing process
(7) Washing processing process→bleaching processing process→washing processing process
(8) Washing processing process→bleaching processing process→washing processing process→fixing processing process
(9) Color development processing process→bleaching processing process→fixing processing process
(10) Color development processing process→bleach-fixing processing process
(11) Color development processing process→bleaching processing process→washing processing process
(12) Color development processing process→bleaching processing process→washing processing process→fixing processing process
(13) Color development processing process→washing processing process→bleaching processing process→fixing processing process
(14) Color development processing process→washing processing process→bleach-fixing processing process
(15) Color development processing process→bleaching processing process
(16) Color development processing process→bleaching processing process→washing processing process
(17) Color development processing process→washing processing process→bleaching processing process
(18) Color development processing process→washing processing process
(19) Fixing processing process→water washing processing process
(20) Fixing processing process→stabilization processing process Generally, the washing processing process in steps (2) through (4) is a process for washing out the bleaching processing solution. Generally, the washing processing process in steps (5) through (18) is a process for washing out the color development processing solution.

In the case of monochrome photographic photosensitive material, the following processes can be listed as embodiments in which plural types of processing processes are provided in a single down-conveyance path in the plural conveyance paths, however, the present invention is not limited by these embodiments. In the following processes, the direction of conveyance is sequentially shown from left to right.

(1) Washing processing process→fixing processing process
(2) Development processing process→fixing processing process
(3) Development processing process→washing processing process→fixing processing process
(4) Development processing process→washing processing process
(5) Development processing process→washing processing process→fixing processing process→water washing processing process
(6) Development processing process→fixing processing process→water washing processing process (7) Development processing process→fixing processing process→stabilization processing process Generally, the washing processing process is a process for washing out the development processing solution.

It is not necessary that the down-conveyance path is provided vertically, but may be provided diagonally.

Next, embodiments common to examples shown in FIGS. 1, 2, 14, 15 and 16 will be described.

In view of the conveyance accuracy, it is preferable that conveyance rollers are arranged as the conveyance roller pair. However, the conveyance rollers may be arranged in such a manner that the rollers are opposed to a guide or a conveyance belt and are in pressure contact with them, or the conveyance rollers may be arranged zigzag. In this connection, it is preferable that the rollers are arranged as conveyance roller pairs or zigzag, when silver halide photographic photosensitive material, which forms a transmission-type image, or reflection-type images on both surfaces by processing, is processed. For silver halide photographic photosensitive material, which forms a reflection-type image on one surface by processing, (for example, common printing paper), although it is preferable that the rollers are arranged as conveyance roller pairs or zigzag, it is also preferable that the conveyance rollers are arranged in such a manner that the rollers are opposed to a guide or a conveyance belt and are in pressure contact with them. In this case, it is preferable that the guide or the conveyance rollers are arranged so that the image forming surface, (the emulsion surface on the printing paper), is conveyed facing the conveyance rollers, from the view point of preventing damage on the image forming surface, the prevention of unevenness, and the processing solution stirring property.

For materials of conveyance rollers in the case where the processing solution maintaining function is not required, materials, in which chemical resistance to the processing solution is high, are preferable, that is, for example, rubber materials such as silicone-type rubber, EPDM-type rubber and fluorine-type rubber; resin materials such as phenol resins, PPS resins, modified PPO resins, PPE resins, polyethylene resins, polypropylene resins, polytviunyl chloride resins, fluorine-type resins, silicone-type resins, polyamide resins, polyacrylnitrile resins, ethylene.vinyl alcohol copolymer resins, and polyvinylidene chloride resins, are preferable. The conveyance roller may be entirely formed of a single material, or the surface portion and the central portion may be formed of different materials.

The interior of the conveyance roller may be solid or hollow. The conveyance roller may be structured of a single member, or materials of the roller shaft and the other portions may be different from each other. Further, the conveyance roller may be structured such that a roller shaft penetrates the entire central portion of the conveyance roller; the roller shaft does not penetrate the entire central portion of the conveyance roller, and roller shafts provided on both ends of the conveyance roller are supported by bosses set on both ends of the central portion of the conveyance roller; or other structures may also be applied for the conveyance roller. In the case where members of the roller shaft and the other portions are formed of different materials, the member of the other portions may be structured by a single member, or the boss engaged on the roller shaft and the outer peripheral layer provided around the boss; or other members may also be applied for the conveyance roller. As the material of the roller shaft, metal, such as stainless steel (SUS316, SUS316L or SUS317) or titanium is preferably used. Structures of such conveyance rollers are disclosed, for example, in Japanese Patent Publication Open to Public Inspection Nos. 44032/1996, and 40052/1995.

In the case where the conveyance roller has a roller shaft, bosses engaged with the roller shaft, and an outer peripheral layer provided around the bass, both ends of the boss and the outer peripheral layer may be on the same plane; the boss may protrude from the end of the outer peripheral layer; or the boss may be recessed from the end of the outer peripheral layer, and in any case, the length of the roller is the length of the outer peripheral layer, in the direction of the conveyance roller shaft.

For materials of guides to form the flow-path of the processing solution, materials, in which chemical resistance against the processing solution is high, are preferable, that is, for example, rubber materials such as silicone-type rubbers, EPDM-type rubbers and fluorine-type rubbers; resin materials such as phenol resins, PPS resins, modified PPO resins, PPE resins, polyethylene resins, polypropylene resins, polytviunyl chloride resins, fluorine-type resins, silicone-type resins, polyamide resins, polyacrylnitrile resins, ethylene.vinyl alcohol copolymer resins, and polyvinylidene chloride resins, and metal materials such as titanium, titanium alloys and stainless alloys are preferable.

Generally, the respective processing solutions are controlled so as to have temperatures not less than 20° C. and not higher than 40° C. However, when the temperature of the rinsing water or the stabilizing solution is adjusted to be not less than 40° C. and not higher than 60° C., a more rapid rinsing effect or rapid stabilizing effect is obtained, which is also preferable in the light of consequential down-sizing of the apparatus.

In the developing solution, dihydroxy benzene compounds such as hydroquinones; aminophenol compounds such as N-methyl-p-amino phenol; pyrazolidone compounds such as 1-phenyl-3-pyrazolicone; reducing agents and ascorbic acid compounds are preferably used as developing agents. Into the developing solution, other additives such as thiosulfites, organic reducing agents, chelating agents, hardeners, anti-silver sludge agents, buffers, development accelerators, anti-foggants, etc., may be added. The pH of the developing solutions of monochromatic photographic photosensitive materials for black-and-white photography is usually not less than 9 and not higher than 12.

In the color developing solution, aromatic primary amino color developing agents such as p-phenylenediamine type compounds, aminoiphenol compounds, etc., are used preferably. When these aromatic primary amino color developing agents are used as the main ingredient of the color developer, it is preferable that the color developing solution is an aqueous alkalne solution. Into the color developing solution, besides those mentioned above, pH adjustors such as salts of weak metal acids (carbonates, borates, phosphates, etc.); preservers such as sulfites, hydroxylamines, diethylhydroxylamines, hydrazines, phenyl semicarbazide, triethanolamine or catecol sulfonate, etc.; organic solvents such as ethylene glycol or diethylene glycol, etc.; chelating agents such as aminopoly organic acids (carboxylic acids, phosphoric acids, etc.); development accelerators such as benzyl alcohol, amines, etc.; fogging agents such as sodium borone halide, etc.; auxiliary developing agents such as 1-phenyl-3-pyrazolidone, etc.; anti-foggants such as benzimidazoles, benzthiazoles, mercapto compounds, etc.; dye-forming couplers; competing couplers; organic reducing agents; hardening agents; anti-silver sludging agents; etc. may also be added.

Into bleaching or bleach-fixing solutions, as the bleaching agent, multi-valent metallic (iron(III), cobalt(III), chromium (IV), copper(II), etc.) compounds, persulfates, quinone compounds or nitro compounds are preferably used. Among these, ferric(III) polyaminopolycarboxylic acid complexes such as ferric(III) ethylenediamine-N-(b-oxyethyl)N,N',N'-triacetate complexes, ferric(III) cyclohexanediaminetetraacetate complexes, ferric(III) ethyletherdiamine tetraacetate complexes, phenylenediamine acetate complexes, ferric(III) ethylene diamine tetra acetate complexes, etc. or persulfates are preferable in the light of more rapid processability and anti-environmental pollution.

In the bleaching solution or the bleach-fixing solution, bleach accelerators may be added in addition to the bleaching agent. As the bleach accelerator, compounds having a mercapto group or disulfide bond, thiazoline derivatives, thiourea derivatives, iodides, polyoxyethylene compounds, polyamine compounds, bromides can be mentioned. Among these, compounds having a mercapto group or a disulfide bond are preferable in view of the bleach acceleration effect.

Further, in the bleaching or bleach-fixing solution, as a matter of course, blowing of oxygen or air (aeration) can be made in order to enhance bleaching activity of the solution. Also, oxidizing agents such as hydrogen peroxide, bromates, persulfates, etc., may be added in appropriate amounts. Bleach or bleach-fixing solutions, by their nature, absorb oxygen from the air, and thereby naturally enhance bleaching activity.

In fixing or bleach-fixing solutions, thiosulfates, thiocyanates, thioether-type compounds, salts of thiourea, etc. are preferably used. Among these, as the main ingredient, thiosulfates (particularly, sodium thiosulfate, potassium thiosulfate and ammonium thiosulfate) are preferably used.

Into the fixing solution or the bleach-fixing solution, besides the fixing agent, preservatives such as sulfites, bisulfites sulfinates, carbonyl bisulfite addition products, etc.; pH buffers such as acetic acid or boric acid; pH adjuster such as sulfuric acid; chelating agents to soften hard water; etc. may also be added.

For rinsing water, running water, well water, ion exchanged water, refined water by microfiltration or distillation, or distilled water obtained by distilling photographic waste solutions can be used. To this, a small amount of additives such as fungicides, may be added. Moreover, stabilizing solutions contain, for the purpose of stabilizing images, inorganic or organic acids or salts to adjust pH of the membrane. The stabilizing solution may contain, in addition to the above, alkaline agents, aldehyde compounds, chelating agents, fungicides, color tone-adjusting agents, agents for improving residual colors, etc.

It is preferable that the water washing processing process and the stabilization processing process are processes of multi-step counter-flow type. In this case, as the number of processing steps, 2 through 6 steps (specifically 2 through 4) are preferable. Further, it is preferable that the delivery solution of washing water and the stabilizing solution are directly or indirectly supplied into the fixing solution and the bleach-fixing solution. The supply amount of washing water and the stabilizing solution, used in the water washing processing process and the stabilization processing process, is preferably not less than 50 cc/m$^2$ and not more than 1000 cc/m$^2$ per 1 m$^2$ of silver halide photographic photosensitive material.

The washing processing process is a process for washing out the processing solutions, adhering to the silver halide photographic photosensitive material, from the prior processing process, and it is preferable to use simple water in this process. It is preferable that the water used in the washing processing process is directly or indirectly supplied into the processing solution of the previous processing process, and is used as a dilution solution of the replenishing agents for the previous processing process. Further, is preferable that the washing processing process is a multi-step counterflow type process. When the processing process just before the washing processing process is the color development processing process, the supply amount of water used for the washing processing process is preferably not less than 50 cc/m$^2$ and not more than 1000 cc/m$^2$ per 1 m$^2$ of silver halide photographic photosensitive material.

The effects of the present invention described in the section "Effect" and the section "Preferred embodiment" can be generalized as follows.

Because the processing solution is supplied from the upside of the up-path of the photosensitive material conveyance path in each processing process of the present invention, it is not necessary to connect many processing tanks in a series, and the same many-step counter-flow effects as those in such a case can be exhibited. Further, even when a small amount of processing solution is used, and the temperature of processing solution is considerably high (40°–80° C.), because the processing solution renewal ratio is higher, there is no possibility of deterioration caused by oxidation, and quick processing can be achieved. The processing agent replenishment amount is also greatly reduced, so that the size of the automatic development processor can be greatly reduced, and its structure can be greatly simplified.

Still further, because the method in which the required amount of processing solution contacts with the photosensitive material conveyed in the air is adopted in all processing processes, except the immersion type development process, even if an earthquake occurs, there is no possibility that the processing solutions, except the developing solution, are mixed with the developing solution in the developing tank and thereby causing the developing solution to deteriorate.

Yet further, suspended matters due to slime, conventionally generated by washing or stabilizing processing, can also be eliminated by high temperature processing.

A problem of the smell generated by the air-contact of the fixing solution can be solved as follows. The smell of ammonium can be suppressed when the main components of thiosulfate and sulfite are replaced with sodium salt, instead of ammonium salt.

According to the present invention, rapid processability of the development processing of photographic photosensitive material, specifically silver halide photographic photosensitive material, decrease of the processing solution in the processing solution tank and decrease of the amount of replenishment amount of the processing solution, decrease of the delivery of washing water or stabilizing solution, reduction of the processing cost, reduction of the overall size of development processor, and reduction of the production cost, are all accomplished.

Further, the processing reaction becomes more uniform, the efficiency of washing becomes higher, and higher processing quality can be attained.

What is claimed is:

1. An apparatus for processing a photosensitive material with a solution, comprising:

first processing means having a first retaining member in which a solution is stored, the first processing means supplying the solution from the first retaining member to the photosensitive material;

first feeding means for replenishing a solution into the first retaining member;

second processing means positioned beneath the first processing means and having a second retaining member in which a solution is stored, the second processing means supplying the solution from the second retaining member to the photosensitive material;

second feeding means for shifting the solution from the first retaining member to the second retaining member; and conveyance means for conveying the photosensitive material upward from the second processing means to the first processing means so that the photosensitive material is firstly processed by the second processing means and thereafter processed by the first processing means.

2. The apparatus of claim 1, wherein the first feeding means feeds the solution onto the photosensitive material at a position upper than the first processing means so that the solution is replenished into the first retaining member through the photosensitive material.

3. The apparatus of claim 1, wherein the photosensitive material has a length longer than a distance between the first processing means and the second processing means so that the solution is shifted from the first retaining member to the second retaining member through the photosensitive material.

4. The apparatus of claim 1, wherein the first and second processing means comprise a pair of rollers and the first and second retaining members are a retaining material capable of retaining the solution, and wherein each of the pair of rollers is covered with the retaining material so that the solution is supplied from the retaining material to the photosensitive material when the photosensitive material passes between the pair of rollers.

5. The apparatus of claim 1, wherein the retaining material is a porous material.

6. The apparatus of claim 1, wherein the first and second processing means comprise a pair of rollers and the first and second retaining members are a container for retaining the solution, and wherein each of the pair of rollers is dipped in the solution in the container so that the solution is supplied from the container to the photosensitive material when the photosensitive material passes between the pair of rollers.

7. The apparatus of claim 6, wherein the second feeding means is a pipe to connect the container of the first processing means and the container of the second processing means so that the solution overflows through the pipe from the container of the first processing means to the container of the second processing means.

8. The apparatus of claim 1, wherein the first and second processing means comprise a pair of rollers and the first and second retaining members are a retaining material capable of retaining the solution, and wherein the retaining material is arranged to contact with each of the pair of rollers so that the solution is supplied from the retaining material to the photosensitive material when the photosensitive material passes between the pair of rollers.

9. The apparatus of claim 1, wherein the first and second processing means comprise a pair of rollers and the first and second retaining members are a retaining material capable of retaining the solution, and wherein the retaining material is arranged to contact with the photosensitive material so that the solution is supplied from the retaining material to the photosensitive material when the photosensitive material passes along the retaining material.

10. The apparatus of claim 1, further comprising a heater to heat the solution so that the first feeding means replenish the heated solution into the first retaining means.

11. The apparatus of claim 1, wherein the apparatus comprises a first and second process groups each comprising the first processing means, the first feeding means, the second processing means and the second feeding means, the second process group is positioned beneath the first process group, the second process group conducts a process different from that of the first process group so that the photosensitive material is firstly processed by the second process group and thereafter processed by the first process group.

12. The apparatus of claim 1, wherein the photosensitive material is conveyed from a preceding process and carries an amount of a preceding process solution, and wherein the fist feeding means replenish the solution by an amount larger 1 to 50 times than the amount of the preceding process solution.

13. The apparatus of claim 1, wherein the solution is washing water.

14. The apparatus of claim 1, wherein the solution is a stabilizing solution.

15. The apparatus of claim 1, further comprising a tank in which the first processing means, the first feeding means, the second processing means and the second feeding means are incorporated, wherein the tank has an enclosed structure.

* * * * *